US007686296B2

(12) United States Patent
Kaneko et al.

(10) Patent No.: US 7,686,296 B2
(45) Date of Patent: Mar. 30, 2010

(54) SHEET STACKING DEVICE AND IMAGE FORMING APPARATUS INCLUDING THE SAME

(75) Inventors: Hidetoshi Kaneko, Yamatokoriyama (JP); Masatsugu Hatanaka, Kashiwara (JP); Motokazu Nakao, Sakurai (JP); Yoshinori Shiraishi, Tenri (JP); Hideshi Izumi, Ikoma (JP); Toyokazu Mori, Soraku-gun (JP); Yuhi Akagawa, Soraku-gun (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 536 days.

(21) Appl. No.: 11/231,034

(22) Filed: Sep. 19, 2005

(65) Prior Publication Data

US 2006/0071413 A1 Apr. 6, 2006

(30) Foreign Application Priority Data

Sep. 22, 2004 (JP) ..... 2004-275629
Sep. 22, 2004 (JP) ..... 2004-275670
Sep. 22, 2004 (JP) ..... 2004-275690

(51) Int. Cl.
*B65H 31/00* (2006.01)
*B65H 31/26* (2006.01)

(52) U.S. Cl. ..... 271/220; 271/209

(58) Field of Classification Search ..... 271/220, 271/221, 222, 223, 224, 209
See application file for complete search history.

(56) References Cited

U.S. PATENT DOCUMENTS 2,991,999 A * 7/1961 Doerner ..... 271/220
3,537,704 A * 11/1970 Bond ..... 271/177
3,630,517 A * 12/1971 Enskat ..... 271/220
3,957,264 A * 5/1976 Bach et al. ..... 271/287

(Continued)

FOREIGN PATENT DOCUMENTS

JP 60232367 * 11/1985
JP 61166463 * 7/1986
JP 64-008180 1/1989
JP 3-35965 4/1991
JP 3-66955 6/1991

(Continued)

OTHER PUBLICATIONS

"Affix", Merriam-Webster Online Dictionary, Merriam-Webster Online, Jul. 31, 2009.*
"Fix", Merriam-Webster Online Dictionary, Merriam-Webster Online, Jul. 31, 2009.*

*Primary Examiner*—Patrick Mackey
*Assistant Examiner*—Patrick Cicchino
(74) *Attorney, Agent, or Firm*—Edwards Angell Palmer & Dodge LLP; David G. Conlin; David A. Tucker

(57) ABSTRACT

A sheet stacking device includes: an evacuation section for transporting and ejecting sheets; a sheet exit tray for stacking the ejected sheets; an arm supporting member; and a sheet presser arm including a supported end at one end, a free end at the other end which is capable of pressing the sheets stacked on the sheet exit tray directly or via a contact member attached to the free end, and a flexure portion having flexibility between the supported end and the free end. The supported end is attached to the arm supporting member. The arm can apply, by the flexibility of the flexure portion, a pressing force to the sheets stacked on the sheet exit tray and a repulsive force to each of the ejected sheets when a front end of the ejected sheet strikes against the arm.

8 Claims, 21 Drawing Sheets

U.S. PATENT DOCUMENTS 4,789,150 A * 12/1988 Plain ..... 271/220
4,838,539 A * 6/1989 Zimmermann ..... 271/305
5,054,764 A * 10/1991 Phillips et al. ..... 271/189
5,332,210 A * 7/1994 Silverberg et al. ..... 271/220
5,467,974 A * 11/1995 Ishiwata et al. ..... 271/220
5,685,536 A * 11/1997 Barthold ..... 271/220
6,189,882 B1 * 2/2001 Horiuchi et al. ..... 271/65

FOREIGN PATENT DOCUMENTS

JP 08-119520 5/1996
JP 08119520 * 5/1996
JP 2000-177911 6/2000

* cited by examiner

SHEET STACKING DEVICE AND IMAGE FORMING APPARATUS INCLUDING THE SAME

CROSS-REFERENCE TO RELATED APPLICATION

This application is related to Japanese patent application Nos. 2004-275670, 2004-275690 and 2004-275629 which were filed on Sep. 22, 2004, whose priorities are claimed under 35 USC §119, the disclosure of which are incorporated by reference in its entirety.

BACKGROUND OF THE INVENTION

1. Field of the Invention

The present invention relates to a sheet stacking device and an image forming apparatus including the same.

2. Description of the Related Art

A sheet stacking device that stacks sheets output from an image forming apparatus or the like is required to orderly stack the sheets at a predetermined position while keeping an eject order of the sheets, that is, required for a good stacking performance. To this end, a technique for arranging a sheet presser arm that prevents an ejected sheet from projecting downstream of an ejection direction in a sheet reception tray is known (see, for example, Japanese Unexamined Patent Publication No. SHO 64(1989)-8180).

If the number of sheet sizes is one, a shape, a position and the like of the sheet presser arm may be optimized according to the size. However, in a sheet stacking device dealing with a plurality of sizes of sheets, it is necessary to determine the shape and the position of the sheet presser arm so as to obtain the good stacking performance for the sheets of the plural sizes. Actually, however, it is difficult to uniformly obtain the good stacking performance for the sheets of all sizes. For example, in order to press a sheet having a smallest sheet length L1 among all available sizes by the arm, a free end of the arm should be arranged so as to suppress the sheet within the length L1 from exit rollers. In this case, a front end of a sheet having a largest sheet length L2 among all available sizes is pressed by the free end of the arm within the length L1 from the exit rollers. After the front end of the sheet is moved forward by a length equal to or larger than a length (L2–L1) in this state, a rear end of the sheet is apart from the exit rollers and the forward movement is stopped. Accordingly, if the stacking device has a larger difference between L1 and L2, i.e., the stacking device deals with sheets of sizes in a wider range, there is a greater difference in sheet stacking conditions according to the sizes. It is difficult to obtain a uniform action of the sheet presser arm. In this case, if the sheet of a large size is insufficiently stiff or a force of the arm that presses the sheet is excessively strong, then the sheet is wrinkled or smooth eject of the sheet is hampered and the forward movement of the front end of the sheet is often stopped. In order to avoid such a disadvantage, there is known, for example, a technique for providing a movable aligning member called "jogger" on a tray. This technique is intended to press ends of each ejected sheet by the jogger and align the sheets to one another. There is also known a technique for providing both the jogger and the sheet presser arm, and for using the sheet presser arm in an auxiliary manner to the jogger particularly for the sheet of a large size for which it is difficult for the jogger to obtain good stacking performance. Further, there is known, as another sheet aligning technique, a technique for inclining a sheet in one direction, providing a position restricting member in a lower portion of the inclined tray, and offsetting sheets stacked on an inclined tray toward the lower portion of the inclined tray by the action of gravity and aligning the sheets by the position restricting member.

Furthermore, there is a limit to the number of stackable sheets whether the number is small or large. It is, therefore, desirable that the stacking device includes a tray-full detection function or a tray-full prediction function that indicates a user to remove stacked sheets or stops ejecting sheets from the image forming apparatus if the ejected sheets are close to a full capacity of the tray. It is also desired to provide these functions by a simple configuration. To this end, there is known a technique for allowing one detection mechanism to serve as stacking height detection means of a plurality of independently elevatable sheet stacking means (see, for example, Japanese Unexamined Patent Publication No. 2000-177911).

The sheet presser arm according to the conventional techniques needs to press the sheets by an appropriate force to prevent the sheets from being unaligned in all stacked states from a state in which one sheet is stacked on the sheet exit tray to a full state in which sheets are full therein. In addition, it is necessary to set a sheet pressure force so as not to prevent movement of a newly ejected sheet. A mechanism of such a sheet presser arm tends to be complicated.

According to the conventional techniques, a range of sheet sizes in which the good stacking performance can be obtained by the sheet presser arm is restricted to a narrow range. If the jogger is used, it is necessary to provide a complicated aligning mechanism. Besides, since the user may possibly touch the moving member of the jogger, it is preferable to reduce a moving member as much as possible for safety reasons. The technique for inclining the sheet in one direction is simple in configuration. However, if sheets of a large size are stacked, a contact area between upper and lower sheets is large in stacked states and a frictional force that acts on the sheets is high. In order to align the sheets against this frictional force, it is required to set the gradient of the tray sharp. In order to secure the sharp gradient, excessive spaces are necessary below and above the tray, which is disadvantageously unsuited for a small-sized sheet tracker.

Meanwhile, a multifunctional machine having an external shape formed into sideway U-shape and stacking ejected sheets in a central space has become popular following a reduction in a size of the apparatus. Particularly in the multifunctional machine of this type, a sheet stacking device capable of ensuring a sufficient number of stacked sheets and a good stacking performance for the sheets ejected to a size-limited region is desired. In addition, a "movable job separator" that branches an eject destination into a plurality of destinations according to a plurality of printing modes such as a printer mode, a copier mode and a facsimile mode and that partitions the sheets is often installed in the multifunctional machine as the sheet stacking device.

According to the conventional technique, separate mechanisms are provided for the tray-full prediction or tray-full detection function and for the improvement of the stacking performance, respectively. However, as demand for reduction in size of the stacking device rises further strongly, it is desired to simplify and reduce a size of a structure for these functions. It is also desired that the structure can be applied even to the stacking device that includes a plurality of sheet stacking sections as shown in the movable job separator.

SUMMARY OF THE INVENTION

It is an object of the present invention to provide a sheet stacking device that can obtain a good stacking performance with a simple structure and that can be applied to an apparatus that includes a plurality of sheet stacking sections. A sheet presser arm according to the present invention has a simple structure capable of being applied to the apparatus such as a movable job separator that includes a plurality of sheet stacking sections. Further, according to the present invention, tray-full prediction or tray-full detection can be performed with a simple configuration.

According to a first aspect of the present invention, there is provided a sheet stacking device comprising: an evacuation section for transporting and ejecting sheets; a sheet exit tray for stacking the ejected sheets; an arm supporting member; and a sheet presser arm including a supported end at one end, a free end at the other end which is capable of pressing the sheets stacked on the sheet exit tray directly or via a contact member attached to the free end, and a flexure portion having flexibility between the supported end and the free end, the supported end being attached to the arm supporting member, wherein the arm can apply, by the flexibility of the flexure portion, a pressing force to the sheets stacked on the sheet exit tray and a repulsive force to each of the ejected sheets when a front end of the ejected sheet strikes against the arm.

According to a second aspect of the present invention, there is provided a sheet stacking device comprising: an evacuation section for transporting and ejecting sheets; a sheet exit tray for stacking the ejected sheets; an arm supporting member located above the evacuation section; and a sheet presser arm including a supported end at one end, a free end at the other end which is capable of pressing the sheets stacked on the sheet exit tray directly or via a contact member attached to the free end, and a flexure portion having flexibility between the supported end and the free end, the flexure portion having a bend or a curve, the supported end being attached to the arm supporting member; a flexure restricting section located above the arm for restricting an upward movement of the flexure portion which moves upward while flexing as the free end rises; a tray-full prediction sensor for detecting that the upward movement of the flexure portion is restricted by the flexure restricting section; and a tray-full detection sensor for detecting, when the free end still rises even after the upward movement of the flexure portion is restricted, that the limit of the upward movement of the free end is reached.

According to a third aspect of the present invention, there is provided a sheet stacking device comprising: an evacuation section for transporting and ejecting sheets; a sheet exit tray for stacking the ejected sheets; an arm supporting member; and a sheet presser arm including a supported end at one end, a free end at the other end which is capable of pressing the sheets stacked on the sheet exit tray directly or via a contact member attached to the free end, and a flexure portion having flexibility between the supported end and the free end, the supported end being attached to the arm supporting member, wherein the arm is disposed in such a manner that the shortest distance between the evacuation section and a position at which the arm strikes against a front end of each sheet and an angle between the arm and the sheet at the position at which the arm strikes against the front end of the sheet are determined so that (1) the free end is situated at a position where the shortest distance between the evacuation section and a point at which the free end or the contact member comes into contact with the sheet exit tray is greater than the length of the sheet of a first size in a transport direction, (2) after a rear end of the sheet of the first size passes through the evacuation section, a front end of the sheet strikes against the arm in a state in which a transport force is not applied from the evacuation section to the sheet and the sheet falls downward while the moving speed of the sheet in an ejection direction is reduced or while the sheet is moved to a direction opposite to the ejection direction by a repulsive force from the arm, and (3) a front end of the sheet of a second size larger than the first size strikes against the arm and passes below the free end in a state in which a transport force is applied from the evacuation section to the sheet, and movement of the sheet in the ejection direction stops after a rear end of the sheet passes through the evacuation section, the sheet exit tray is disposed in such a manner that the position of the tray relative to the arm and the inclination of the tray relative to a horizontal plane are determined so that the sheet of the first size falling downward on the sheet exit tray is stacked while being inclined toward the upstream side, and so that the sheet of the second size whose front end passes below the free end is stacked while being pressed by the free end, and the arm supporting member is configured to be capable of determining the position of the arm supporting member relative to the evacuation section so that the shortest distance from the evacuation section to the position at which the sheet of the first size strikes against the arm can be set according to the length of the sheet of the first size.

In the sheet stacking device according to the first aspect of the present invention, the arm can apply a pressing force to the sheet stacked on the sheet exit tray and a repulsive force to the sheet when a front end of the ejected sheet strikes against the arm, by the flexibility of the flexure portion. It is, therefore, possible to ensure a good stacking performance for sheets of sizes in a wide range with a simple structure. In addition, the structure of the arm can be applied to a sheet stacking device such as a movable job separator including a plurality of sheet stacking sections.

Here, the free end of the arm moves upward or downward according to the stacking height of the sheets while the supported end of the arm keeps its position at which it is attached to the supporting member.

The sheet stacking device is particularly suitable for an instance in which the sheet stacking device is to be made compact by stacking sheets in large quantities within a limited space or an instance in which the sheet stacking device is applied to a job separator having the detection mechanism provided to each of a plurality of sheet exit trays.

The terms "the arm has the flexibility" mean that the arm is elastically deformable by receiving an external force. The external force may be a force by which the free end is pushed upward by the stacked sheet in a state in which the arm is attached to the sheet stacking device, or a force applied to the arm by causing the front end of the ejected sheet strikes against the arm.

Further, the sheet stacking device according to the second aspect of the present invention includes a flexure restricting section located above the arm for restricting an upward movement of the flexure portion which moves upward while flexing as the free end rises; a tray-full prediction sensor for detecting that the upward movement of the flexure portion is restricted by the flexure restricting section; and a tray-full detection sensor for detecting, when the free end still rises even after the upward movement of the flexure portion is restricted, that the limit of the upward movement of the free end is reached. Therefore, by detecting the state of the bend or the curve and the free end of the sheet presser arm are restricted by the flexure restricting section, it is possible to improve the stacking performance for the sheets stacked on the sheet exit tray and to detect the tray-full prediction and the tray-full detection corresponding to the sheet stacking height of one or more sheets by one arm. Namely, it is possible to realize the good stacking performance for the stacked sheets with the simple structure and detect the sheet stacking height of one or more sheets. The sheet-full prediction or sheet-full detection mechanism that is compact, high in reliability, and inexpensive can be thereby realized.

The flexure restricting section refers to a section that functions to restrict the free end and the bend or the curve of the arm that rises as the free end rises not to rise up to a predetermined height. The flexure restricting section is arranged to sequentially restrict the upper limit of the rise of the bend or the curve and the free end as they rises. The supported end of the arm may be fixed to the arm supporting member. However, the present invention is not limited thereto. The supported end of the arm may be, for example, pivotally supported by the arm supporting member so as to rotate as the free end of the arm rises and attached to the arm supporting member so as to press the sheet exit tray or the stacked sheets by the self-weight of the arm or a spring force in an axial rotation direction.

The tray-full prediction sensor or the tray-full detection sensor may be, for example, a push switch detecting that the bend or free end of the arm abuts on the flexure restricting section. However, the present invention is not limited thereto. An arbitrary member can be used as the sensor as long as the member can detect that the arm is located at the predetermined position. For example, a photo interrupter arranged to interrupt an optical path from a light emitting section to a light receiving section while the arm abuts on the flexure restricting section can be used to realize the sensor. Further, a magnetic sensor, a permeability sensor or the like may be used as the sensor.

In the sheet stacking device according to the third aspect of the present invention, the arm supporting member is configured so that a position of the arm supporting member relative to the evacuation section is selectable so that the shortest distance from the evacuation section to the position at which the sheet of the first size strikes against the arm according to a length of the sheet of the first size. The length of the sheet of the first size can be made to correspond to an optimum size according to a utilization state. It is, therefore, possible to select the position of the supported end of the arm according to the sheets of a size frequency used by the user and ensure the good stacking performance for the sheets of the size.

Moreover, an image forming apparatus according to the present invention includes one of the above-described sheet stacking devices. The image forming apparatus according to the present invention is, therefore, realized for the sheets, ejected from the stacking device, of sizes in a wide range with the good stacking performance.

In the sheet stacking device according to the first aspect of the present invention, the sheet exit tray may include: a sheet stacking section for obliquely stacking the sheets so that an upstream side of the ejected sheets in an ejection direction is at a lower position than a downstream side of the sheets; and a sheet restricting section located at an upstream side end of the sheet stacking section, the arm is disposed in such a manner that the shortest distance between the evacuation section and a position at which the arm strikes against the front end of the sheet and an angle between the arm and the sheet at the position at which the arm strikes against the front end of the sheet are determined so that (1) the free end is situated at a position where the shortest distance between the evacuation section and a point at which the free end or the contact member comes into contact with the sheet exit tray is greater than the length of the sheet of a first size in a transport direction, (2) after a rear end of the sheet of the first size passes through the evacuation section, a front end of the sheet strikes against the arm in a state in which a transport force is not applied from the evacuation section to the sheet and the sheet falls downward while the moving speed of the sheet in an ejection direction is reduced or while the sheet is moved to a direction opposite to the ejection direction by a repulsive force from the arm, and (3) a front end of the sheet of a second size larger than the first size strikes against the arm and passes below the free end in a state in which a transport force is applied from the evacuation section to the sheet, and movement of the sheet in the ejection direction stops after a rear end of the sheet passes through the evacuation section, and the sheet exit tray is disposed in such a manner that the position of the tray relative to the arm and the inclination of the tray relative to a horizontal plane are determined so that the sheet of the first size falling downward on the sheet exit tray is stacked while being inclined toward the upstream side, and so that the sheet of the second size whose front end passes below the free end is stacked while being pressed by the free end.

By doing so, the arm is disposed in such a manner that the shortest distance between the evacuation section and a position at which the arm strikes against the front end of the sheet and an angle between the arm and the sheet at the position at which the arm strikes against the front end of the sheet are determined so that (1) the free end is situated at a position where the shortest distance between the evacuation section and a point at which the free end or the contact member comes into contact with the sheet exit tray is greater than the length of the sheet of a first size in a transport direction, (2) after a rear end of the sheet of the first size passes through the evacuation section, a front end of the sheet strikes against the arm in a state in which a transport force is not applied from the evacuation section to the sheet and the sheet falls downward while the moving speed of the sheet in an ejection direction is reduced or while the sheet is moved to a direction opposite to the ejection direction by a repulsive force from the arm, and (3) a front end of the sheet of a second size larger than the first size strikes against the arm and passes below the free end in a state in which a transport force is applied from the evacuation section to the sheet, and movement of the sheet in the ejection direction stops after a rear end of the sheet passes through the evacuation section, and the sheet exit tray is disposed in such a manner that the position of the tray relative to the arm and the inclination of the tray relative to a horizontal plane are determined so that the sheet of the first size falling downward on the sheet exit tray is stacked while being inclined toward the upstream side, and so that the sheet of the second size whose front end passes below the free end is stacked while being pressed by the free end. It is, therefore, possible to obtain the good stacking performance for sheets of sizes in a wide range including the first size and the second size larger than the first size with the simple structure.

The contact member is a member that contacts with the sheet to the extent that the member does not obstruct the forward movement of the sheet when the sheet is applied with the transport force from the exit rollers and moved forward. The contact member may be, for example, a roller attached to the free end of the arm. The sheet restricting section is a member arranged so that the sheet obliquely stacked on the sheet exit tray slides toward the lower gradient side and so that one end of the sheet abuts on the restricting member to provide sheet aligning. The sheet restricting section may be a wall member. However, the present invention is not limited thereto. The sheet restricting section may be, for example, a plurality of columnar members.

In this specification, a sheet size means a length of the sheet in the ejection direction irrespective of a length thereof in a direction orthogonal to the ejection direction.

The arm may be configured such that when the front end of the ejected sheet strikes against the arm, the sheet receives a repulsive force from the arm due to the self-weight or flexibility of the arm or due to both, and the angle between the arm and a traveling direction of the front end of the sheet striking against the arm, the self-weight of the arm, the flexibility of the arm or all of these are determined so that after the front end of the sheet of the first size strikes against the arm in the state in which a transport force is not applied from the evacuation section to the sheet, the sheet falls downward while the moving speed of the sheet in the ejection direction is reduced or while the sheet is moved to the direction opposite to the ejection direction, and so that after the front end of the sheet of the second size strikes against the arm in the state in which a transport force is applied from the evacuation section to the sheet of the second size, the front end of the sheet descends and passes below the free end of the arm.

The arm may be a member consisting of one elastic body. By doing so, the arm can be realized with a simpler structure.

The flexibility and the shape of the arm may be determined so that a pressing force that does not obstruct traveling of each sheet passing below the free end of the arm is applied to the sheets in a sheet stacking state equal to or smaller than an allowable stacking amount. By doing so, sheets can be stacked with the good stacking performance in a range of all stacking quantities from the first sheet ejected onto the sheet exit tray until the sheets are full on the sheet exit tray.

The arm may have a bend between the supported end and the free end, and the shape of the arm may be determined in view of the attachment angle of the supported end of the arm with respect to a horizontal direction, the length of the flexure portion between the supported end and the bend, and the length of the flexure portion between the bend and the free end. By doing so, the shape of the arm is determined in view of the factors that particularly greatly influence the sheet pressing force. It is, therefore, expected to efficiently discover the optimum pressing force applied to the sheet.

Alternatively, the flexibility and the shape of the arm may be determined so that when the front end of each sheet strikes against the arm in a state in which a transport force is not applied from the sheet evacuation section to the sheet, the sheet falls downward while the moving speed of the sheet in an ejection direction is reduced or while the sheet is moved to a direction opposite to the ejection direction by a repulsive force from the arm. By doing so, every sheet can be satisfactorily stacked from the first sheet ejected onto the sheet exit tray until the sheets are full on the sheet exit tray.

Alternatively, the arm may have a bend between the supported end and the free end, and the shape of the arm may be determined in view of an angle formed between two sides of the arm between which the bend is held. Alternatively, the arm may have a bend between the supported end and the free end, and the shape of the arm may be determined in view of the length of the flexure portion between the bend and a point at which the sheet strikes against the arm. By doing so, the shape of the arm is selected in view of the factors that greatly influence the repulsive fore applied to the sheet when the front end of the sheet strikes against the arm. It is, therefore, expected to efficiently discover the optimum pressing force applied to the sheet.

The free end of the pressure arm may include a bend or a rotatable roller serving as the contact member may be attached to the free end of the arm. The bend or the roller may be configured to pass below the free end. By so configuring, the free end of the arm does not obstruct the transport of the sheet and does not damage the surface of the sheet.

Further, according to the present invention, there is provided a sheet stacking device including an evacuation section that transports and ejects a sheet, a sheet exit tray that aligns ejected sheets to one another and stacks the sheets, and the sheet presser arm. Since the sheet stacking device according to the present invention includes the sheet presser arm of the simple structure, the structure of the sheet stacking device itself can be simplified. It is, therefore, preferable to apply the sheet stacking device particularly to a sheet stacking device such as a movable job separator including a plurality of sheet stacking sections since the sheet stacking device of the simple structure can be realized.

Moreover, the sheet stacking device may be configured as follows. The sheet stacking device further includes a first stacking sensor and a second stacking sensor that detect a state of the sheets stacked on the sheet exit tray, and the sheet presser arm has a bend between the supported end and the free end. When the free end of the sheet presser arm rises as the sheets are stacked on the sheet exit tray, the first stacking sensor of the arm is turned on when the bend reaches the upper limit position. Thereafter, the free end side further flexes from the bend and the free end rises in the state in which the bend is restricted to the upper limit position. The second stacking sensor is turned on when the free end of the arm reaches the upper limit position. It is thereby possible to detect multiple stacking states of the sheets stacked on the sheet exit tray. By so configuring, the arm of the simple structure can be utilized to improve the sheet stacking performance and to detect the stacking state, and the both functions can be realized by the simple mechanism.

The arm is configured so that the front end of the ejected sheet receives the repulsive force from the arm by the action of one of or both the self-weight and the flexibility of the arm. The angle formed by the traveling direction of the front end of the sheet striking against the arm with respect to the arm and one of or both the self-weight and the flexibility of the arm may be selected so that the sheet of the first size falls downward while the moving speed of the sheet in the ejection direction is reduced or the sheet is moved in the opposite direction after the front end of the sheet of the first size strikes against the arm in the state in which the transport force is not applied from the evacuation section to the sheet of the first size, and so that the front end of the sheet of the second size is lowered and passes below the free end of the arm after the front end of the sheet of the second size strikes against the arm in the state in which the transport force is applied to the sheet from the evacuation section. If so, by appropriately setting the angle formed by the traveling direction of the front end of the sheet striking against the arm with respect to the arm and one of or both of the self-weight and the flexibility of the arm, it is possible to ensure the good stacking performance for the sheets of sizes in a wide range.

The sheet stacking section of the sheet exit tray may include an inclined portion so that a sheet of a size equal to or smaller than the first size is stacked with the rear end thereof offset toward the restricting member by the self-weight of the sheet when the sheet falls downward on the sheet exit tray. By doing so, it is possible to ensure the good stacking performance by the action of the inclined portion of the sheet exit tray and the restricting member for the sheets of the size equal to or smaller than the first size.

The arm may be arranged to strike against a central portion of a front end-side side of the ejected sheet or to strike against two points equidistant from the central portion of the front end-side side of the ejected sheet.

By so arranging, when the sheet strikes against the arm, the laterally symmetric repulsive force about the axis passing the central portion of the front end-side side of the sheet and extending in the ejection direction is applied to the sheet from the arm. Due to this, a moment for deviating the sheet to a direction orthogonal to the ejection direction does not act on the sheet. It is, therefore, possible to ensure the good stacking performance for the direction orthogonal to the ejection direction of the sheet.

In the sheet stacking device according to the second aspect of the present invention, the arm includes a flexure portion having flexibility between the supported end and the free end.

The flexure portion may have a plurality of bends or curves, the flexure restricting section restricts upward movements of the bends or curves sequentially from the bend on the supported end side to the bend on the free end side as the free end rises, and the sheet stacking device comprises a plurality of tray-full prediction sensors, one for each of the bends or curves. By doing so, the tray-full prediction and a plurality of the tray-full detection corresponding to the stacking height of one or more sheets stacked on the sheet exit tray can be performed by one arm. It is, therefore, possible to realize detection of multiple sheet stacking heights with the simple structure.

Alternatively, the flexure portion may have the curve, and the stacking device may comprises a plurality of tray-full prediction sensors which are provided on points on the curve, respectively, so as to detect that upward movements of the points are sequentially restricted from the point on the support end side to the point on the free end side as the free end rises.

By doing so, the tray-full prediction and the tray-full detection corresponding to the stacking height of one or more sheets stacked on the sheet exit tray can be performed by one arm. It is, therefore, possible to realize detection of multiple sheet stacking heights with the simple structure.

Alternatively, the flexure restricting section may be vertically movable, and the tray-full prediction sensor or the tray-full detection sensor may serve to detect the limit of a downward movement of the flexure restricting section when the flexure restricting section moves vertically. By so configuring, the tray-full prediction sensor or the tray-full detection sensor can also function to detect the lower limit of the movement of the flexure restricting section. It is, therefore, unnecessary to provide a dedicated detection sensor or detection mechanism to the detection of the lower limit of the movement of the flexure restricting section. A movable tray control mechanism simple in structure, inexpensive, and high in reliability can be realized, accordingly. Further, if the flexure restricting section is arranged on the lower surface of the movable tray, this configuration enables detecting the lower limit of the movement of the tray.

The free end of the arm or the contact member attached to the free end may be in contact with the sheet exit tray when the sheets are not stacked on the sheet exit tray, and is in contact with the uppermost sheet when the sheets are stacked on the sheet exit tray.

The flexure restricting section may restrict the upward movement of the flexure portion by a lower surface of the flexure restricting section abutting the bend or curve of the flexure portion, and said tray-full prediction sensor is disposed on a surface of the flexure restricting section against which the bend or points on the curve of the flexure portion abut.

By doing so, the restriction of each portion of the arm to the upper limit is provided by the abutment of the arm on the flexure restricting section. It is, therefore, possible to realize accurate detection by a simple detection mechanism and realize inexpensive and highly reliable sheet full prediction and full detection.

The sheet exit tray may be a movable tray that moves vertically, and the tray-full prediction sensor or the tray-full detection sensor may serve to detect the limit of an upward movement of the sheet exit tray when the sheet exit tray moves vertically. It is, therefore, unnecessary to provide a dedicated detection sensor or detection mechanism to the detection of the upper limit of the movement of the tray. A movable tray control mechanism simple in structure, inexpensive, and high in reliability can be realized, accordingly.

The sheet exit tray may move to a second tray position above a first tray position for stacking the sheet by a predetermined distance during an interval between a previous sheet ejection and a next sheet ejection, and the sheet exit tray may return to the first tray position after detection by the tray-full prediction sensor, the tray-full detection sensor or by both to find out how high a sheet stack on the sheet exit tray is based on a detection result of the tray-full prediction sensor, the tray-full detection sensor or of both at the second tray position. By doing so, the degree of the sheet stacking height can be obtained from a detection result of one of or both the tray-full prediction sensor and the tray-full detection sensor at the second tray position. As compared with an instance in which the sheet stacking height is detected only at the first tray position, twofold sheet stacking heights can be detected, and a more detailed state can be obtained for the sheet stacking height.

The sheet exit tray may move to a second tray position below a first tray position for ejecting the sheet by a predetermined distance during an interval between a previous sheet ejection and a next sheet ejection, and the sheet exit tray may return to the first tray position after detection by the tray-full prediction sensor, the tray-full detection sensor or by both to find out how high a sheet stack on the sheet exit tray is based on a detection result of the tray-full prediction sensor, the tray-full detection sensor or of both at the second tray position. By doing so, the degree of the sheet stacking height can be obtained from a detection result of one of or both the tray-full prediction sensor and the tray-full detection sensor at the second tray position. As compared with an instance in which the sheet stacking height is detected only at the first tray position, twofold sheet stacking heights can be detected, and a more detailed state can be obtained for the sheet stacking height.

The sheet stacking device may further include a failure-to-fetch-sheets sensor that detects whether sheets are present on the region in which the sheets are stacked on the sheet exit tray. By doing so, even if the sheet stacking height is equal to or smaller than the height corresponding to the tray-full prediction or detection, it is possible to detect that sheets remain on the sheet exit tray. It is, therefore, possible to notify the user of the failure to fetch the sheets and to urge the user to perform an operation for evacuating the sheet exit tray. For example, if printing is performed in an image forming apparatus in which sheets in large quantities are ejected at one time, it is effective to perform the failure-to-fetch-sheets detection and urge the user to evacuate the tray before the start of image formation so as to prevent the sheets from becoming full on the sheet exit tray during the image formation. Further, if the tray-full prediction sensor or the tray-full detection sensor also functions to detect the upper limit or lower limit of the movement of the tray, the upper or lower limit position may possibly not be set to a fixed position due to the influence of the sheets stacked on the tray. In this case, if the upper or lower limit position of the tray is to be accurately controlled, the failure-to-fetch-sheets detection is performed before the movement of the tray. If sheets that are not fetched are present, the tray is not moved. After the sheets are removed, the tray is moved.

Alternatively, the sheet stacking device according to the present invention comprises: a movable tray that is vertically movable and that is arranged at either a sheet stacking position below a evacuation section at which position a sheet from the evacuation section is stacked or a retreat position above the evacuation section at which position the sheet from the evacuation section cannot be stacked; a first arm that is a sheet presser arm at least a part of which has a flexibility, and that includes a supported end that is one end supported by an arm supporting member arranged above the evacuation section, a free end in contact with the movable tray or the sheet stacked on the movable tray either directly or via a contact member downstream of the supported end in a sheet ejection direction, and one or more bends formed between the supported end and the free end and being upward convex; a first flexure restricting section that is arranged above the first arm and that restricts each bend rising as the free end of the first arm rises to an upper limit position; a movable tray-full prediction sensor provided to correspond to each bend of the first arm for detecting that the each bend of the first arm is in a state in which the bend is restricted by the first flexure restricting section; a movable tray-full detection sensor that detects that a stacking height of the stacked sheets reaches an upper limit and the sheets are full on the movable tray when the free end of the first arm further rises in the state in which the bend of the first arm is restricted to the upper limit position, and that detects that the free end of the first arm is close to the first flexure restricting section by a predetermined distance and restricts the movable tray to the upper limit position when the movable tray is vertically moved; a fixed tray that stacks ejected sheets when the movable tray is located at the retreat position; a second arm that is a sheet presser arm at least a part a part of which has a flexibility, and that includes a supported end that is one end supported by an arm supporting member arranged on a lower surface of the movable tray, a free end in contact with the fixed tray or the sheet stacked on the fixed tray either directly or via a contact member downstream of the supported end in the sheet ejection direction, and one or more bends formed between the supported end and the free end and being upward convex; a second flexure restricting section that is arranged on the lower surface of the movable tray and that restricts a bend closer to the movable tray as the free end of the second arm is closer to the lower surface of the movable tray to a limit position; a fixed tray-full prediction sensor provided to correspond to the bend of the second arm for detecting that the bend of the second arm is in a state in which the bend is restricted by the second flexure restricting section; and a fixed tray-full detection sensor that is arranged on the lower surface of the movable tray, that detects that a stacking height of the stacked sheets reaches an upper limit and the sheets are full on the fixed tray when the free end of the second arm is further closer to the lower surface of the movable tray in the state in which the bend of the second arm is restricted to the upper limit position, and that detects that the free end of the second arm is close to the lower surface of the movable tray by a predetermined distance and restricts the movable tray to the lower limit position when the movable tray is vertically moved.

Further, the sheet stacking device according to the present invention may include a display section that displays information based on the detection of the tray-full prediction sensor or the tray-full detection sensor. By doing so, it is possible to display one or more stages of the sheet-full prediction and the sheet-full state on the display section to notify the user of a state of the sheet stacking height, and to urge the user to remove the stacked sheets at appropriate timing based on the detection result of the sensor. Alternatively, the position of the movable tray or the flexure restricting member is displayed on the display section if it is necessary to do so and the user can be notified of the position. Alternatively, it is determined that there is an abnormality in the detection of the upper or lower limit position when the movable tray or the flexure restricting member is moved, and the abnormal state can be displayed on the display section.

Furthermore, the image forming apparatus according to the present invention comprises one of the above-described sheet stacking devices.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

First Embodiment

In a first embodiment, an overall structure of a sheet stacking device and that of an image forming apparatus that includes the sheet stacking device according to the present invention will be described.

Figure 2:
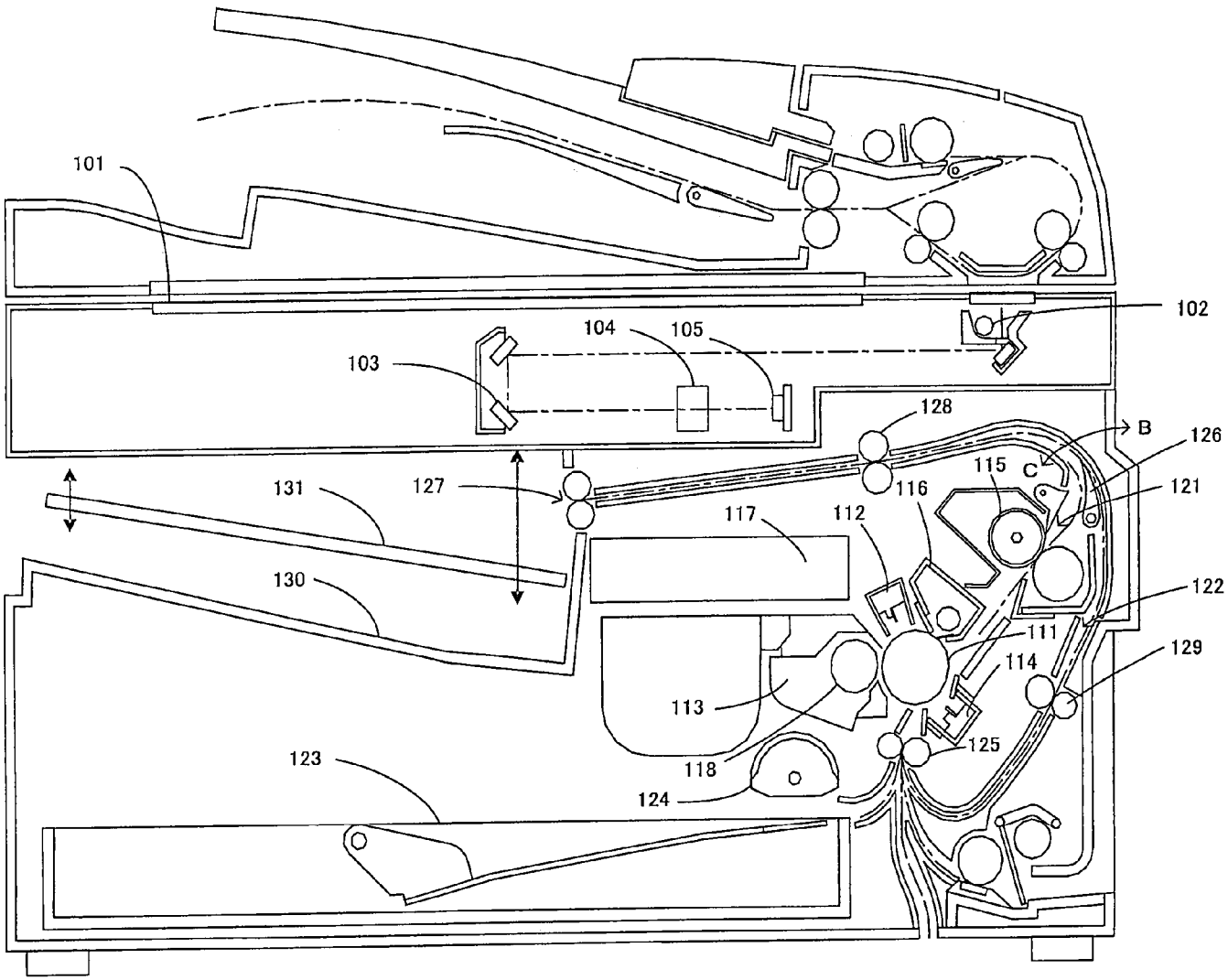
FIG. 2 is an explanatory view that illustrates an example of a configuration of an image forming apparatus according to a first embodiment of the present invention.

FIG. 2 is an explanatory view that illustrates an example of a configuration of the image forming apparatus according to the first embodiment. As shown in FIG. 2, the image forming apparatus according to the first embodiment is generally configured by a scanner section, a printing section, and a sheet transport section as the other section.

The scanner section irradiates an original with light and generates image data according to an image of the original from the reflected light. The printing section generates a visible image based on the image data generated by the scanner section, and prints this visible image on a predetermined transfer sheet (hereinafter, simply "sheet"). The sheet transport section supplies the sheet to the printing section and ejects the printed sheet. The sheet transport section also includes a roller driving mechanism that is a characteristic constituent element of the image forming apparatus, which mechanism will be described later.

Respective constituent elements of the image forming apparatus according to this embodiment will be described. The scanner section will first be described. The scanner section includes an original base plate 101 consisting of a transparent glass and provided on an upper surface thereof. A scanner optical system is provided below this original base plate 101. This scanner optical system includes an exposure light source 102, a reflecting mirror 103, an image formation lens 104, and a photoelectric conversion device (CCD) 105. The exposure light source 102 is a light source 102 for irradiating light onto the original mounted on the original base plate 101. The reflecting mirror 103 guides the reflected light from the original to the image formation lens 104 and the CCD 105 as indicated by, for example, one-dot chain lines shown in FIG. 2. The CCD 105 receives the reflected light formed by the image formation lens 104 and generates an electric signal corresponding to this reflected light as an image signal.

The printing section and the sheet transport section will next be described. The printing section includes a photosensitive roller 111, a charging unit 112, a developing unit 113, a transfer charger 114, fixing rollers 115, a cleaner 116, a laser scanning unit (LSU) 117 which is not shown, and a image-fixed sheet detection switch. The photosensitive roller 111 is a drum-shaped photosensitive roller 111, and a sheet transported on a main transport path 121, to be described later, is driven to rotate at the same speed as that of the photosensitive roller 111 so as to contact with a surface of the roller 111. The charging unit 112 charges the surface of the photosensitive roller 111 at a predetermined potential. The LSU 117 scans the surface of the charged photosensitive roller 111 with laser light in a direction parallel to a rotation axis of the photosensitive roller 111 and exposes the surface thereof to the light, thereby forming an electrostatic latent image on the surface of the photosensitive roller 111 according to the image signal of the original read by the scanner section. The developing unit 113 develops the electrostatic latent image, which is formed on the surface of the photosensitive roller 111 by the LSU 117, with the use of a developing roller 118, and forms a toner image (developed image) on the surface of the photosensitive roller 111. The transfer charger 114 transfers the toner image formed on the photosensitive roller 111 onto the sheet. The fixing rollers 115 thermally fix the unfixed toner image transferred onto the printed sheet onto the sheet. The image-fixed sheet detection switch detects that the sheet passes through the fixing rollers 115. The cleaner 116 removes residual toners on the surface of the photosensitive roller 111 after the toner image is transferred onto the sheet.

The sheet transport section includes a main transport path 121, a sub-transport path 122, a fixed sheet cassette 123, a pickup roller 124, registration rollers 125, a guide member 126, a eject port 127, exit rollers 128, transport rollers 129, and a prior-registration detection switch which is not shown. The fixed sheet cassette 123 stores sheets used for printing. The pickup roller 124 is a semicircular roller for outputting sheets from the fixed sheet cassette 123 one by one. The prior-registration detection switch detects that the sheet transported by the pickup rollers 124 passes through a predetermined position on the main transport path 121, and outputs a predetermined detection signal. The registration rollers 125 temporarily hold the sheet transported on the main transport path 121. The registration rollers 125 also function to transport the sheet at good timing according to the rotation of the photosensitive roller 111 so as to be able to transfer the toner image on the photosensitive roller 111 onto the sheet by synchronizing a front end of the toner image with a front end of the sheet. Namely, the registration rollers 125 transport the sheet so that the front end of the toner image on the photosensitive roller 111 is synchronized with a front end of a print region of the sheet based on the detection signal output from the prior-registration detection switch.

The exit rollers 128, which are provided near the eject port 127, are rollers for ejecting the sheet fed from the fixing rollers 115 to a first sheet exit tray 130 or a second sheet exit tray 131 (a movable tray arranged above the fixed sheet cassette 123 and below the scanner section). The exit rollers 128 as well as the guide member 126 and the sub-transport path 122 act as a back-side printing mechanism. Namely, during ordinary one-side printing, the guide member 26 is arranged in a direction B shown in FIG. 2, so that the sheet can be transported from the main transport path 121 to the exit rollers 126. During two-side printing, if printing on a first side (front side) of the sheet is finished and a rear end of the sheet is ejected from the main transport path 121, then the guide member 126 is rotated in a direction A and arranged so that the sheet sent back from the exit rollers 128 can be guided to the sub-transport path 122. The exit rollers 128 are rotated in a traveling direction (a direction in which the sheet is ejected from the eject port 127) until the rear end of the sheet ejected from the fixing rollers 115 passes through the guide member 126, and then rotated in a backward direction. Thus, the sheet is transported to the sub-transport path 122 through the guide member 126, transported again to the registration rollers 125 by the transport rollers 129, and printing is performed on a second side (back side).

Second Embodiment

In a second embodiment, a first example of ensuring a good stacking performance for stacking sheets by an action of a sheet presser arm and a sheet exit tray will be described.

Figure 1A:
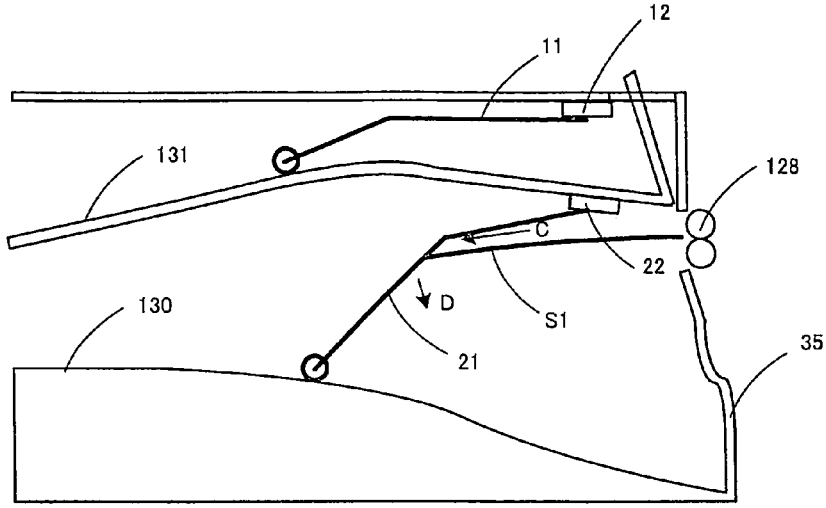
FIGS. 1A to 1C are explanatory views that illustrate a state in which sheets of a first size are stacked according to a second embodiment of the present invention.
Figure 1B:
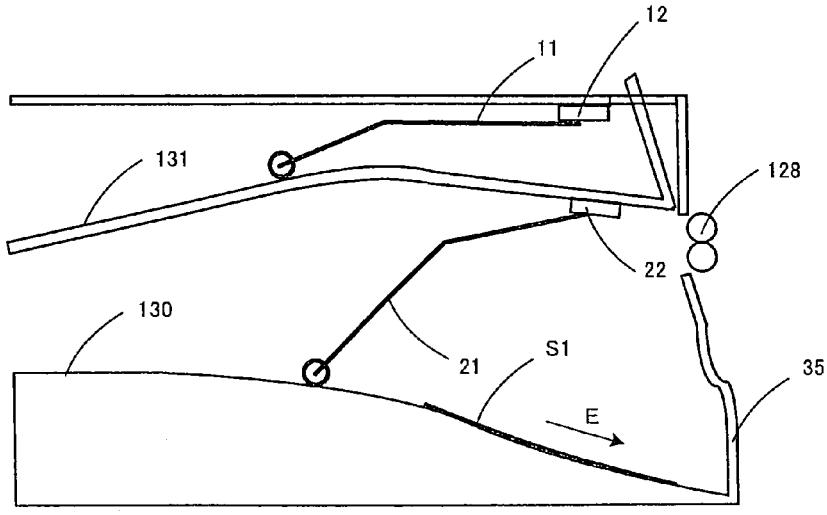
Figure 1C:
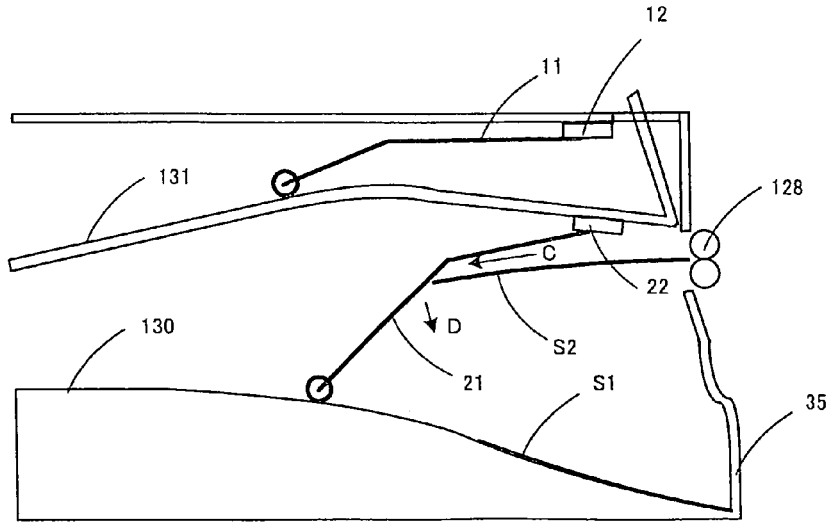

FIGS. 1A to 1C are explanatory views that illustrate a state in which ejected sheets of a first size are stacked in the sheet stacking device that includes the sheet presser arm according to the present invention. FIGS. 1A to 1C illustrate an instance in which the ejected sheets are stacked on the first sheet exit tray 130. A doglegged sheet presser arm 21 having a bend is arranged on the first sheet exit tray 130. One end of the arm 21 is fixed to an arm supporting member 22 arranged below the second sheet exit tray 131, and the other end thereof is in contact with the first sheet exit tray 130 via a roller. The arm 21 has flexibility and the roller on the free end is pressed against the first sheet exit tray 130 by an elastic force of the arm 21.

The action of the arm 21 and the first sheet exit tray 130 on the sheet of the first size is as follows. A sheet S1 transported while a front end thereof passes through the exit rollers 128 is moved in a direction of an arrow C while a traveling direction thereof is kept substantially horizontal by a transport force applied from the exit rollers 128 and "stiffness" of the sheet S1 even after the front end passes through the exit rollers 128. Thereafter, a rear end of the sheet S1 separates from the exit rollers 128 and travels substantially in a horizontal direction with a transport speed of the exit rollers 128 set as its initial speed of the sheet S1, and then the front end of the sheet S1 strikes against the sheet presser arm 21. Since the arm 21 has elasticity, the sheet S1 receives a repulsive force in a direction of an arrow D from the arm 21 and a moving speed of the sheet S1 is reduced or the sheet S1 is moved to a direction opposite to the ejection direction by the repulsive force form the arm 21 as shown in FIG. 1A. As a result, the sheet S1 loses the speed in an ejection direction and spontaneously falls downward on the first sheet exit tray 130 as shown in FIG. 1B. Since the first sheet exit tray 130 is inclined, the sheet S1 slides toward an upstream side indicated by an arrow E by an action of its self-weight. In addition, as shown in FIG. 1C, the sheet S1 strikes against a sheet restricting portion 35 provided on one end of the first sheet exit tray 130 and stops. A sheet S2 ejected next to the sheet S1 is stacked on the sheet S1 so that one end of the sheet S2 strikes against the sheet restricting portion 35 of the first sheet exit tray 130 through the same process as that of the sheet S1. Thus, the sheets of the first size are orderly stacked on the first sheet exit tray 130.

As described above, the arm 21 is arranged at the position at which the front end of the sheet of the first size strikes against the arm 21 while the rear end of the sheet of the first size separates from the exit rollers 128 and travels substantially horizontally. In addition, the angle between the arm 21 and the sheet at the position at which the arm strikes against the front end of the sheet, and an elastic force resulting from the flexibility of the arm 21 are set so that the front end of the sheet strikes against the arm 21 and the sheet thereby falls downward while the speed of the sheet in the ejection direction is reduced or the sheet returns in an opposite direction. The angle therebetween is particularly determined by an attachment angle of the arm 21 by which the arm 21 is attached to the supporting member 22 and a bending angle of the arm 21. It is thereby possible to ensure the good stacking performance for the sheets of the first size.

If it is assumed that a length of the sheet of the first size is L3, a distance by which the rear end of the sheet separates from the exit rollers 128 and the sheet is moved in space while the traveling direction of the sheet is kept substantially horizontal at the initial speed that is the transport speed of the transport rollers 128 is d, and a position at which the sheet presser arm 21 is to be arranged so that the arm 21 strikes against the sheet is X, then the following relationship is satisfied for the position X.

$$L3<X\leqq L3+d$$

Figure 4A:
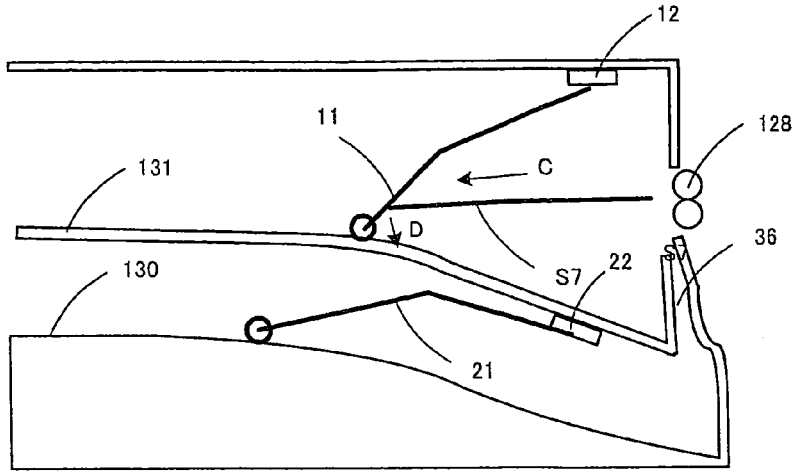
FIGS. 4A to 4C are explanatory views that illustrate a state in which a ejected sheet S7 of the first size is stacked on a second sheet exit tray according to the second embodiment of the present invention.
Figure 4B:
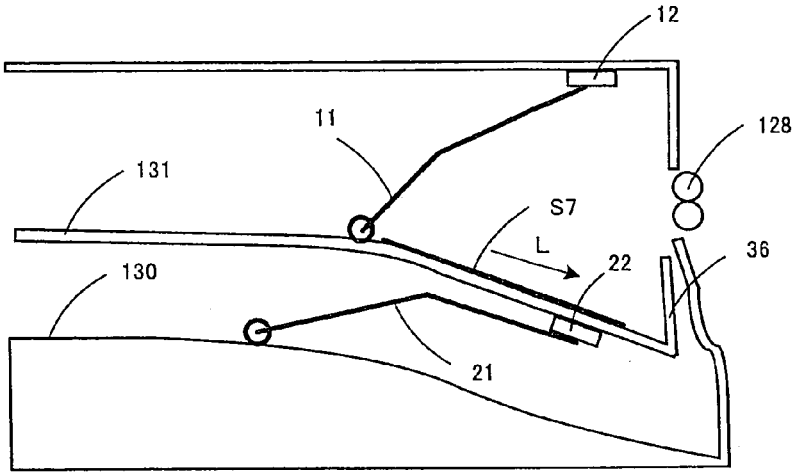
Figure 4C:
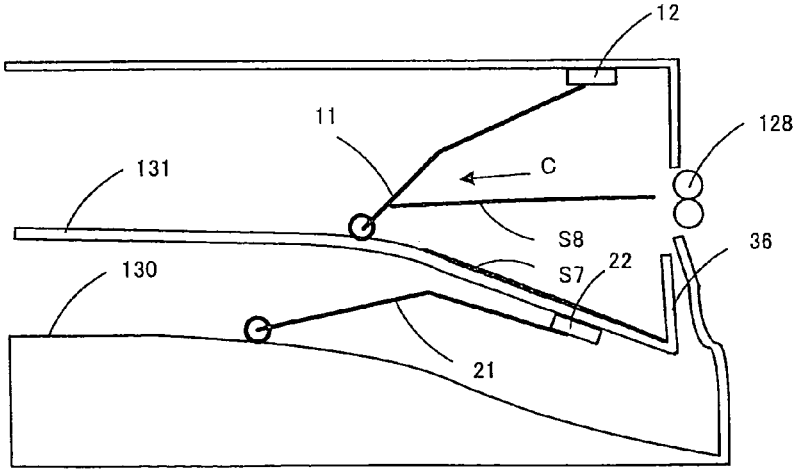
Figure 5A:
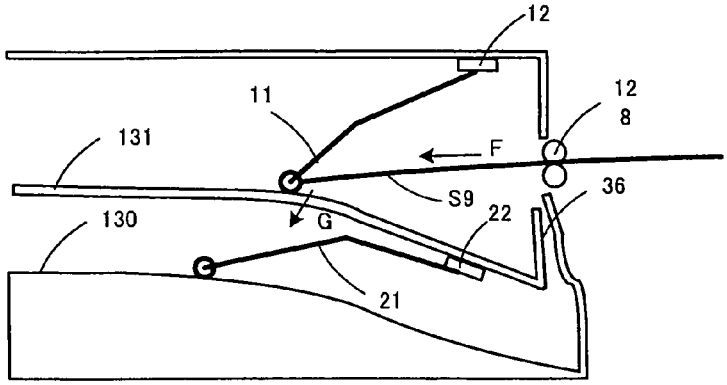
FIGS. 5A to 5D are explanatory views that illustrate a state in which a ejected sheet S9 of the second size is stacked on the second sheet exit tray according to the third embodiment of the present invention.
Figure 5B:
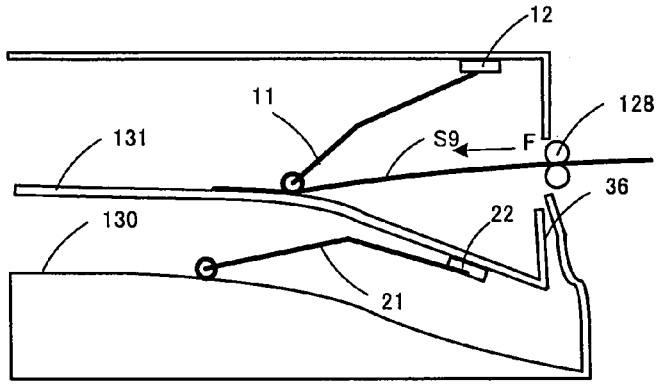
Figure 5C:
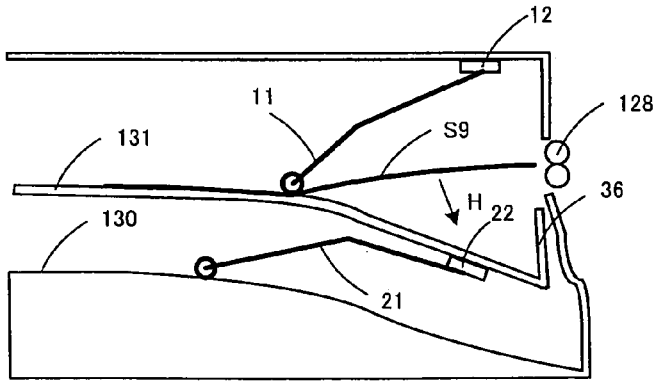
Figure 5D:
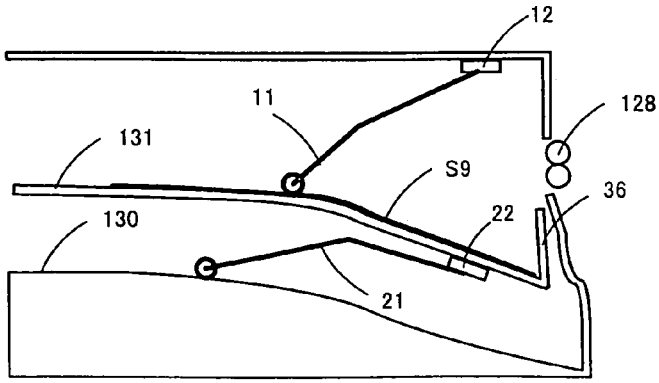

FIGS. 4A to 4C show an instance in which an ejected sheet S7 of the first size is stacked on the second sheet exit tray 131. In this case, similarly to the above, an arm 11 is arranged at a position at which a front end of the sheet S7 of the first size strikes against the arm 11 while a rear end of the sheet S7 separates from the exit rollers 128 and travels substantially horizontally. In addition, the angle between the arm 11 and a traveling direction of the front end of the sheet striking against the arm 11 is set so that the front end of the sheet S7 strikes against the arm 11 and the sheet S7 thereby falls downward while the speed of the sheet S7 in the ejection direction is reduced or the sheet returns in the opposite direction. The angle therebetween is particularly determined by an attachment angle of the arm 11 by which the arm 11 is attached to the supporting member 12 and a bending angle of the arm 11. The attachment angle of the arm 11 and an elastic force resulting from the flexibility of the arm 11 are set so that the sheet S7 receives a repulsive force by which the speed of the sheet S7 in the ejection direction is reduced or the sheet S7 is moved in the opposite direction. It is thereby possible to ensure the good stacking performance for the sheets of the first size ejected onto the second sheet exit tray 131.

Third Embodiment

In a third embodiment, a second example of ensuring the good stacking performance for stacking sheets by the action of the sheet presser arm and the sheet exit tray will be described.

FIGS. 3A to 3D are explanatory views that illustrate a state in which ejected sheets S3 of a second size larger than the first size are stacked in the sheet stacking device that includes the sheet presser arm according to the present invention. The action of the arm 21 and the first sheet exit tray 130 on the sheet of the second size is as follows.

Figure 3A:
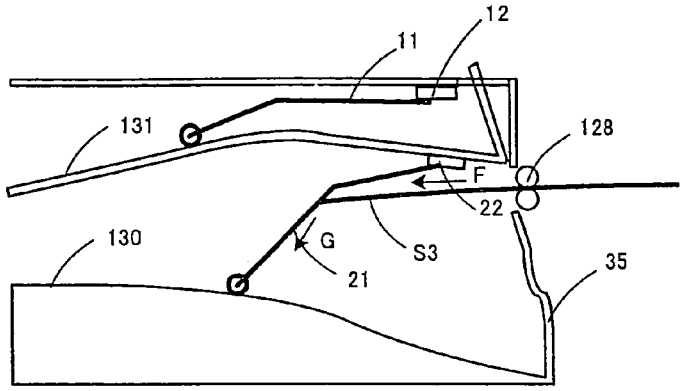
FIGS. 3A to 3D are explanatory views that illustrate a state in which a sheet S3 of a second size larger than the first size is ejected and stacked in a sheet stacking device including a sheet presser arm according to a third embodiment of the present invention.
Figure 3B:
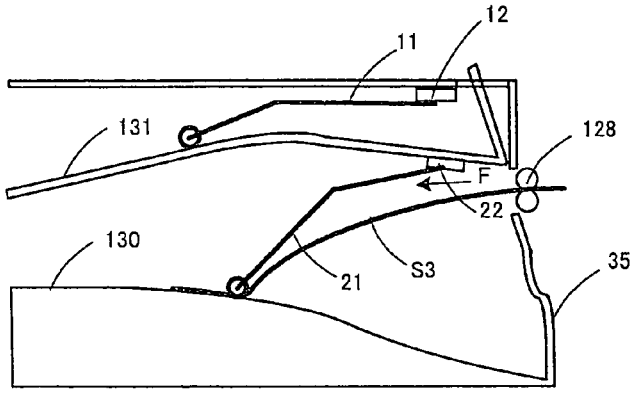
Figure 3C:
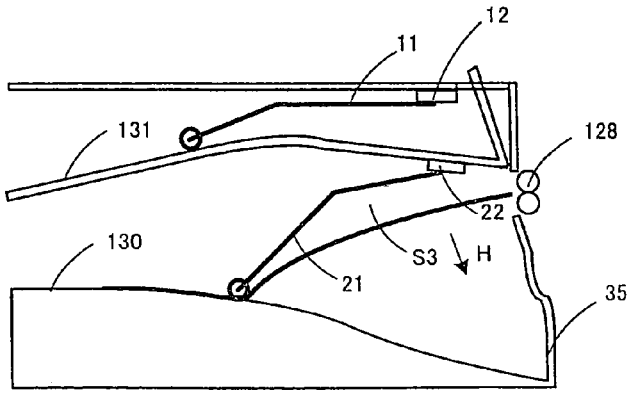
Figure 3D:
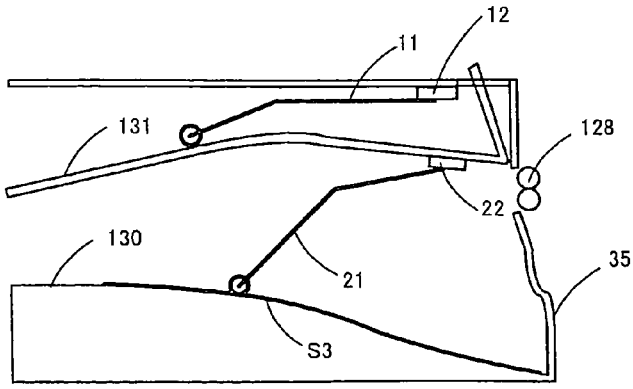

A sheet S3 transported while a front end thereof passes through the exit rollers 128 is moved in a direction of an arrow F while a traveling direction thereof is kept substantially horizontal by the transport force applied from the exit rollers 128 and "stiffness" of the sheet S3 even after the front end passes through the exit rollers 128. In case of the sheet S3, before a rear end of the sheet S3 separates from the exit rollers 128, therefore, while the transport force in the sheet ejection direction is applied, the front end of the sheet S3 strikes against the sheet presser arm 21. In addition, as shown in FIG. 3A, the sheet S3 receives a downward repulsive force downstream of the sheet ejection direction by the elasticity of the arm 21 as indicated by an arrow G. As a result, the front end of the sheet S3 falls downward along the arm 21, strikes against the first sheet exit tray 130, and passes below the free end of the arm 21 along the first sheet exit tray 130. Before the rear end of the sheet S3 separates from the exit rollers 128, the front end of the sheet S3 is moved forward downstream of the ejection direction along the first sheet exit tray 130 by the transport force from the exit rollers 128 and the "stiffness" of the sheet S3 as shown in FIG. 3B. When the rear end of the sheet S3 separates from the exit rollers 128, the sheet S3 loses the transport force from the exit rollers 128. At this time, the sheet S3 is pressed by the roller attached to the free end of the arm 21. Therefore, a braking force is applied to the sheet S3 by a frictional force generated by friction between the sheet S3 and the first sheet exit tray 130, so that the forward movement of the sheet S3 in the sheet ejection direction stops as shown in FIG. 3C. A portion of the sheet S3 upstream of the roller attached to the free end of the arm 21 spontaneously falls downward on the first sheet exit tray 130 as indicated by an arrow H shown in FIG. 3D. A sheet S4 ejected next to the sheet S3 is stacked on the sheet S3 on the first sheet exit tray 130 through the same process as that of the sheet S3. Thus, the sheets of the second size are orderly stacked on the first sheet exit tray 130.

As described above, the arm 21 is arranged at the position at which the front end of the sheet of the second size strikes against the arm 21 before the rear end of the sheet of the second size separates from the exit rollers 128. In addition, the angle between the arm 21 and the sheet at the position at which the arm strikes against the front end of the sheet and the bending angle of the arm 21 are set so that the front end of the sheet falls downward along the arm 21 and passes below the free end of the arm 21. The angle therebetween is particularly determined by the attachment angle by which the arm 21 is attached to the supporting member 22. The elastic force resulting from the flexibility of the arm 21 is set so as not to obstruct the forward movement of the sheet when the sheet is moved forward below the free end and so as to brake the sheet after the rear end of the sheet separates from the exit rollers 128. Positions of the free end and the supported end of the arm 21 relative to the exit rollers 128 and arrangement of the first sheet exit tray 130 relative to the exit rollers 128 are determined thereby ensuring the good stacking performance for the sheets of the second size.

FIGS. 5A to 5D show an instance in which an ejected sheet S9 of the second size is stacked on the second sheet exit tray 131. In this case, similarly to the above, the arm 11 is arranged at a position at which a front end of the sheet S9 strikes against the arm 11 before a rear end of the sheet S9 separates from the exit rollers 128. In addition, the angle between the arm 11 and a traveling direction of the front end of the sheet striking against the arm 11 is set so that the front end of the sheet S9 strikes against the arm 11, and so that the sheet S9 thereby falls downward along the arm 11 and passes below the free end of the arm 11. The angle therebetween is particularly determined by the attachment angle of the arm 11 by which the arm 11 is attached to the supporting member 12 and the bending angle of the arm 11. An elastic force resulting from the flexibility of the arm 11 is set so as not to obstruct the forward movement of the sheet S9 when the sheet S9 is moved forward below the free end and so as to apply the braking force to the sheet S9 after the rear end of the sheet S9 separates from the exit rollers 128. It is thereby possible to ensure the good stacking performance for the sheets of the second size ejected to the second sheet exit tray 131.

Fourth Embodiment

Figure 6C:
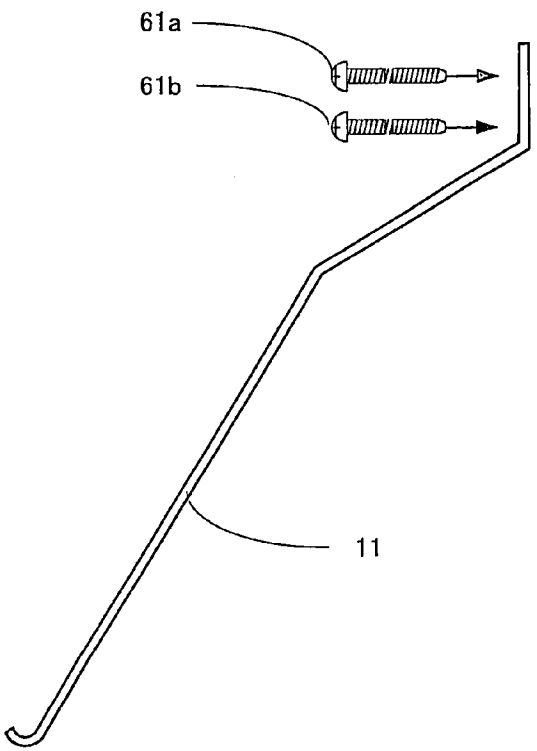
FIGS. 6A to 6C are explanatory views that illustrate a sheet presser arm according to a fourth embodiment of the present invention.
Figure 6B:
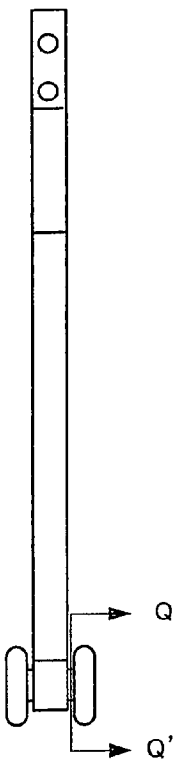
Figure 6A:
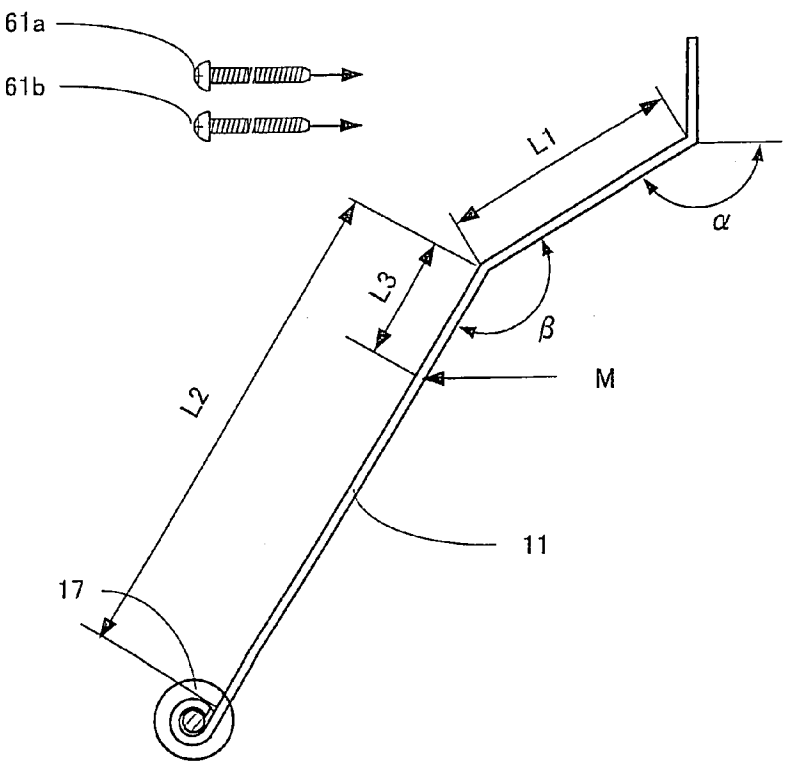

In a fourth embodiment, the sheet presser arm will be described. FIGS. 6A to 6C are explanatory views that illustrate the sheet presser arm according to the fourth embodiment of the present invention. FIGS. 6A and 6B show that a roller 17 is attached to the free end of the sheet presser arm 11. FIG. 6A illustrates the arm 11 viewed from a direction orthogonal to the sheet ejection direction, and FIG. 6B illustrates the arm 11 viewed from a direction parallel to the sheet ejection direction. In addition, FIG. 6A is a sectional view of the roller 17 viewed from a direction of Q-Q' of FIG. 6B so as to help understanding of a shape of the arm 11. The roller 17 is attached rotatably to the arm 11 and presses a sheet from above. When the pressed sheet is moved forward in the ejection direction, the roller 17 rotates so as not to obstruct the forward movement of the sheet or not to leave a trace of the roller 17 on a surface of the sheet. As shown in FIG. 6C, the free end of the arm 11 may not have the roller but have a curved portion. Due to the curved portion, when the free end of the arm 11 presses the sheet from above, a smooth curved portion comes in contact with the sheet. Accordingly, when the pressed sheet is moved forward in the ejection direction, the forward movement of the sheet is not obstructed and the trace of the arm 11 is not left on the surface of the sheet.

The arm 11 is integrally formed out of a material having flexibility. The arm 11 may be formed by, for example, working a phosphor bronze plate, a stainless plate or the like. Screw holes are provided in the supported end of the arm 11 opposite to the free end so that the arm 11 can be fixed to the supporting member by screws 61*a* and 61*b*. The arm 11 is attached to the sheet stacking device while the supported end thereof is supported by the supporting member 12 at an angle $\alpha$ with respect to the horizontal direction. Between the supported end and the free end of the arm 11, the bend is formed by bending the arm 11 so as to be convex upward. The bend is formed so as to be held between both sides of the arm 11 at an angle $\beta$ smaller than 180 degrees.

The bend is provided at a position away from the supported end of the arm 11 by the length L1. In addition, a striking point M against which the front end of the ejected sheet of the first size is supposed to strike while the arm 11 is attached to the sheet stacking device is provided at a position away from the bend toward the free end side by the distance L2. The striking point M is a point provided virtually when the arm 11 is designed. The sheet of the first size is arranged relative to the exit rollers 128 so that the front end of the sheet strikes against a portion near the striking point M even if the arm 11 is actually attached to the sheet stacking device.

The arm 11 presses the sheet of the second size on the sheet exit tray from above while being attached to the sheet stacking device. At this time, it is necessary to press the stacked sheets at an appropriate pressing force for all sheet stacked amounts from a state in which a first sheet is stacked on the sheet exit tray until the sheets are full in the sheet exit tray. The appropriate pressing force means herein a pressing force so that if the sheet is transported below the free end of the arm 11, the forward movement of the sheet is not obstructed but so that if the sheet does not receive the transport force, the sheet is braked and stopped without traveling. An optimum pressing force is influenced by various sheet conditions, e.g., the state of the surface and the stiffness of the sheet, and an optimum range thereof is changed according to these various sheet conditions. It is, therefore, difficult to quantitatively show arm design conditions. Accordingly, the designing of the arm 11 is carried out while repeating trials and errors in accordance with an actual apparatus. Nevertheless, several qualitative indexes of design are clear. Namely, the attachment angle $\alpha$ of the supported end of the arm 11 with respect to the horizontal direction, the length L1 of the portion of the arm 11 having the flexibility from the supported end to the bend, and the length L2 of the portion of the arm 11 having the flexibility from the bend to the free end particularly have a great influence on the pressing force applied to the sheet. The portion from the supported end to the bend of the arm 11 is nearly parallel to the stacked sheet as compared with the portion from the bend to the free end thereof. Therefore, in a state in which the bend is freely moved, a flexure of the portion indicated by the length L1 has a greater influence on the pressing force applied to the sheet. However, if the sheets are further stacked while the sheet stacked amount increases and the bend is restricted by the restricting member provided above, the pressing force applied to the sheet is determined by the flexibility of the portion from the bend to the free end of the arm 11 indicated by the length L2. By repeating trials and errors while attention is paid to these design factors, it is expected to be able to efficiently discover the optimum pressing force applied to the sheet.

Further, it is necessary to arrange the arm 11 so that the sheet of the first size that receives the repulsive force from the arm 11 spontaneously falls downward while a moving speed of the sheet in the ejection direction is reduced or the sheet is moved in the opposite direction if the front end of the sheet strikes against the arm 11 in a state in which the arm 11 is attached to the sheet stacking device. It is also necessary to arrange the arm 11 so that the front end of the sheet of the second size that receives the repulsive force from the arm 11 falls downward if the front end thereof strikes against the arm 11 while the sheet is transported by the exit rollers 128.

Various conditions such as the transport speed of the exit rollers 128 for transporting the sheet to the outside of the arm 11, the size of the sheet, and the stiffness of the sheet influence the behavior of the front end of the sheet that receives the repulsive force from the arm 11 to be moved as described above. Due to this, it is difficult to quantitatively show optimum design conditions for the arm 11 and these conditions are actually determined through trials and errors according to the actual apparatus. Nevertheless, several qualitative indexes of design are clear. Namely, a bending angle $\beta$ of the arm 11 and a length L3 of a portion of the arm 11 having the flexibility from the bend to a striking point M have particularly greater influences on the repulsive force applied to the front end of the sheet. This is because the bending angle $\beta$ of the arm 11 is an important factor for determining the angle formed between the traveling direction of the front end of the sheet striking against the arm 11 and the arm 11. In addition, the length from the bend of the arm 11 to the striking point M thereof is an important factor for generating the repulsive force resulting from the flexibility of the arm 11 when the front end of the sheet strikes against the arm 11. Namely, the portion of the arm 11 from the supported end to the bend is nearly parallel to the forward movement direction of the front end of the sheet. The flexibility of this portion does not, therefore, greatly contribute to the repulsive force applied to the sheet as compared with that of the portion from the bend to the striking point M. By repeating trials and errors while attention is paid to these design factors, it is expected to be able to efficiently discover an optimum repulsive force applied to the sheet.

Fifth Embodiment

In a fifth embodiment, an instance in which the sheet presser arm is used so as to both improve the stacking performance and detection of a sheet stacking state will be described. The action of the arm for improving the stacking performance is already described in the second and third embodiments. Such an arm is sometimes desired to also use for detecting the sheet stacking state so as to simplify a detection mechanism. If the sheet stacking device is configured so that the sheet presser arm presses the ejected sheet from above as described in the third embodiment, the sheet presser arm can be used to detect the sheet stacking state. Namely, if the sheet presser arm is configured to act on sheets of all sizes as described in the third embodiment, the sheet presser arm can be used to detect the sheet stacking state.

If a designer attaches greater importance to the improvement in the stacking performance for the sheets of sizes in a wide range, the sheet presser arm may be configured to act on the sheets as described in the second and the third embodiments. If the designer attaches greater importance to the simplification of the detection mechanism, the sheet presser arm may be configured as described in this embodiment. Since the function of the sheet presser arm for improving the stacking performance is as described in the third embodiment, the sheet presser arm that functions to detect the sheet stacking state will be mainly described herein.

Figure 7A:
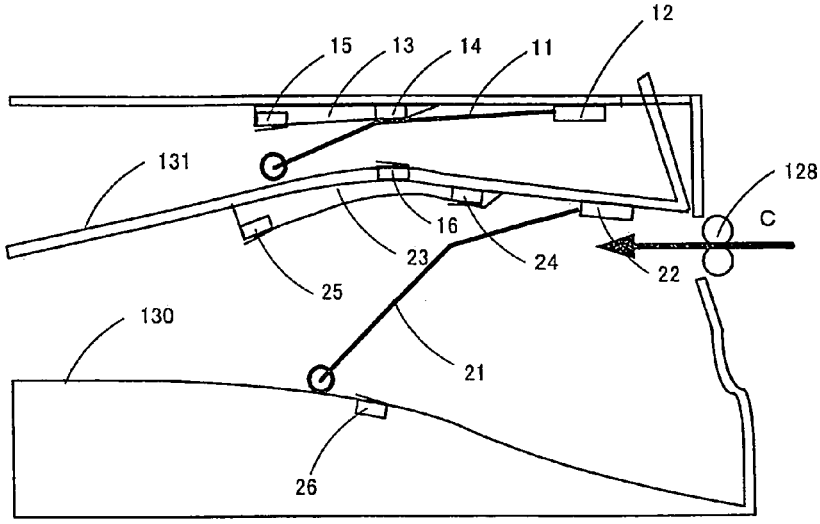
FIGS. 7A to 7C are explanatory views that illustrate an example of a configuration of the sheet stacking device according to a fifth embodiment of the present invention.
Figure 7B:
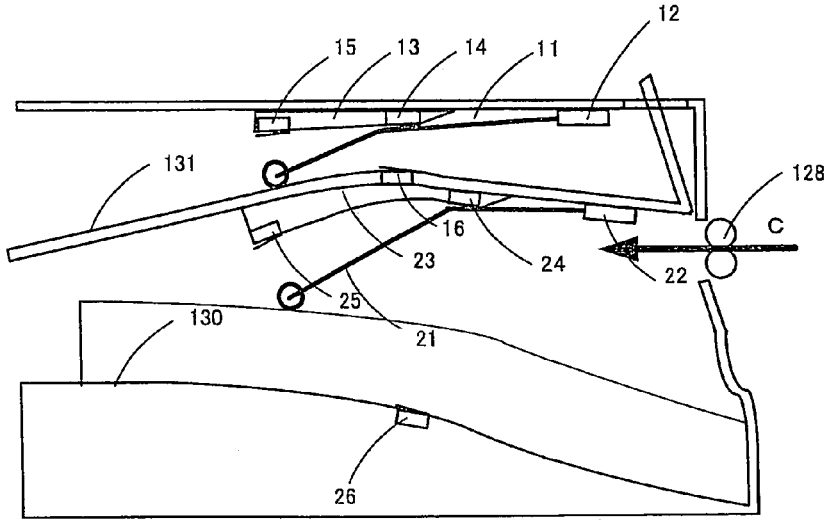
Figure 7C:
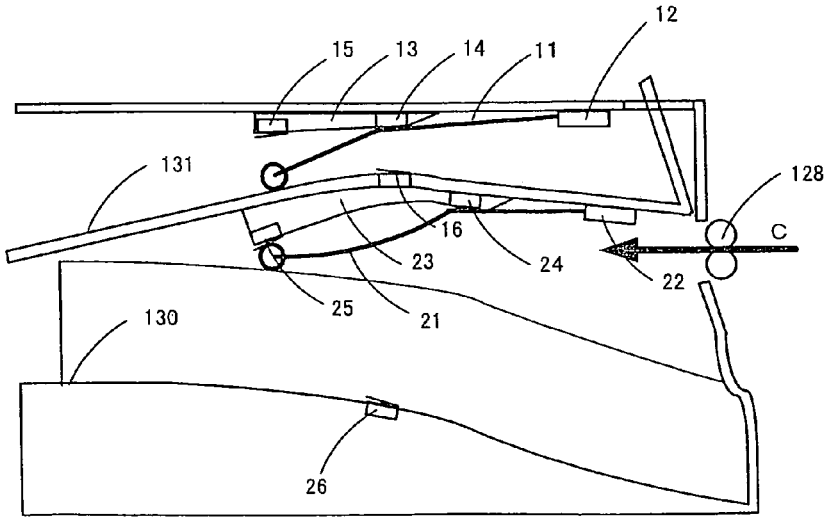

FIGS. 7A to 7C are explanatory views that illustrate an example of the configuration of the sheet stacking device according to the fifth embodiment. FIGS. 7A to 7C show an instance in which the sheet stacking device stacks sheets ejected from the exit rollers 128 in a direction of an arrow C on the first sheet exit tray 130. To detect the sheet stacking state of the first sheet exit tray 130, a flexure restricting portion 23, a first stacking sensor 24 and a second stacking sensor 25 are provided above the arm 21. FIG. 7A illustrates a state in which no sheet is stacked on the first sheet exit tray 130, in which state the free end of the sheet presser arm 21 comes in contact with the first sheet exit tray 130 via the roller attached to the free end thereof. The action of the arm 21 in the process of ejecting the sheets and stacking the sheets on the first sheet exit tray 130 is the same as that described in the third embodiment. The free end of the arm 21 rises by the sheets stacked on the first sheet exit tray 130. Since the arm 21 has flexibility, the arm 21 flexes near a bend as the free end thereof rises. If the sheet stacked amount increases, the bend of the arm 21 abuts on the flexure restricting portion 23 provided above the arm 21 in a short time. The first stacking sensor 24 using, for example, a micro-switch is provided in a portion in which the bend of the arm 21 abuts on the flexure restricting portion 23. If the bend of the arm 21 presses an actuator provided on the sensor 24, the sensor 24 detects this and outputs a first stacking state signal. FIG. 7B illustrates a state in which the bend of the arm 21 rises and abuts on the flexure restricting portion 23 and in which the first stacking sensor 24 outputs a tray-full prediction signal. In this state, if the sheet stacked amount further increases, the free end side of the arm 21 flexes rather than the bend and the free end rises. The roller attached to the free end abuts on the flexure restricting portion 23. The second stacking sensor 25 using, for example, a micro-switch is provided in a portion in which the roller on the free end of the arm 21 abuts on the flexure restricting portion 23. The sensor 25 detects this and outputs a second stacking state signal. FIG. 7C illustrates a state in which the free end of the arm 21 rises and in which the second stacking sensor 25 outputs the second stacking state signal.

Figure 8A:
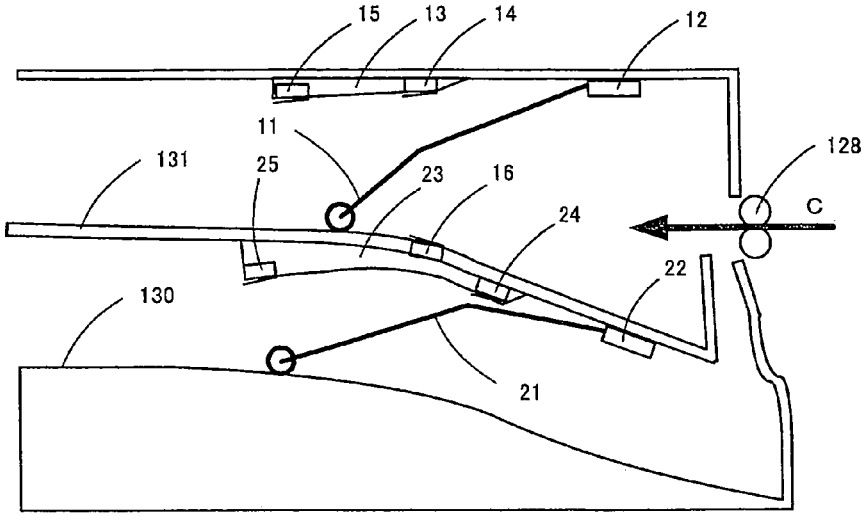
FIGS. 8A to 8C are explanatory views that illustrate a different state of the sheet stacking device according to the fifth embodiment of the present invention.
Figure 8B:
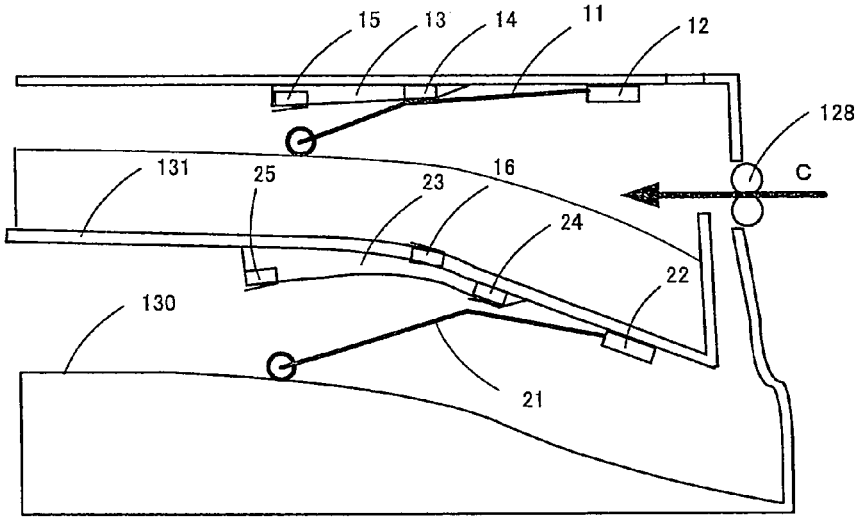
Figure 8C:
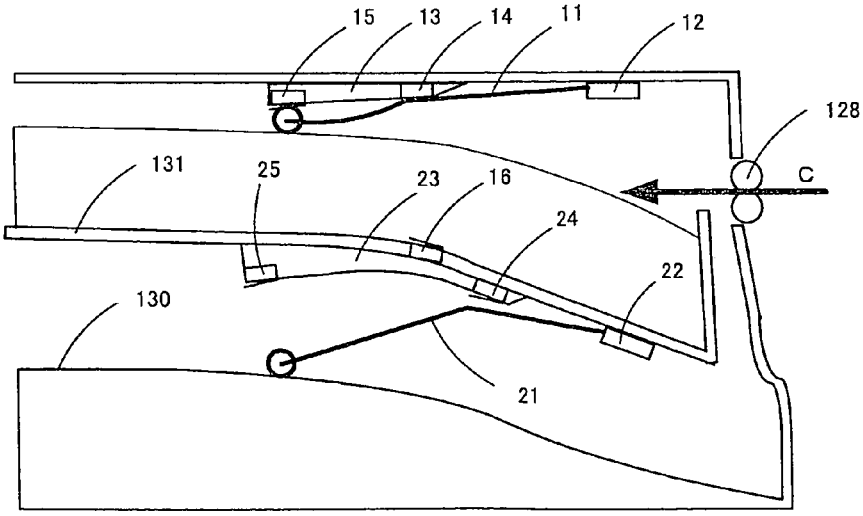

FIGS. 8A to 8C are explanatory views that illustrate a different state of the sheet stacking device according to this embodiment. In FIGS. 8A to 8C, the ejected sheets are stacked on the second sheet exit tray 131. To detect the sheet stacking state of the second sheet exit tray 131, a flexure restricting portion 13, a third stacking sensor 14, and a fourth stacking sensor 15 are provided above the arm 11. FIG. 8A illustrates a state in which no sheet is stacked on the second sheet exit tray 131, in which state the free end of the sheet presser arm 11 comes in contact with the second sheet exit tray 131 via the roller attached to the free end thereof. The free end of the arm 11 rises by the sheets stacked on the second sheet exit tray 131. Since the arm 11 has flexibility, the arm 11 flexes near a bend as the free end thereof rises. If the sheet stacked amount increases, the bend of the arm 11 abuts on the flexure restricting portion 13 provided above the arm 11 in a short time. The third stacking sensor 14 using, for example, a micro-switch is provided in a portion in which the bend of the arm 11 abuts on the flexure restricting portion 13. If the bend of the arm 11 presses an actuator provided on the sensor 14, the sensor 14 detects this and outputs a third stacking state signal. FIG. 8B illustrates a state in which the bend of the arm 11 rises and abuts on the flexure restricting portion 13 and in which the third stacking sensor 14 outputs a tray-full prediction signal. In this state, if the sheet stacked amount further increases, the bend of the arm 11 does not rise since the bend abuts on the flexure restricting portion 13. Instead, the free end side of the arm 11 flexes rather than the bend and the free end rises. The roller attached to the free end abuts on the flexure restricting portion 13. The fourth stacking sensor 15 using, for example, a micro-switch is provided in a portion in which the roller on the free end of the arm 11 abuts on the flexure restricting portion 13. The sensor 15 detects this and outputs a tray-full detection signal. FIG. 8C illustrates a state in which the free end of the arm 11 rises and in which the fourth stacking sensor 15 outputs the fourth stacking state signal.

In this embodiment, the sheet stacking device that includes the two sheet exit trays, i.e., the first and the second sheet exit trays has been described. Alternatively, the sheet stacking device may be configured to include only one sheet exit tray.

Sixth Embodiment

In a sixth embodiment, a third example of ensuring the good stacking performance for stacking sheets by the action of the sheet exit tray will be described.

FIGS. 9A to 9D are explanatory views that illustrate a state in which a sheet S5 of a third size smaller than the first size is ejected and stacked in the sheet stacking device according to the present invention.

Figure 9A:
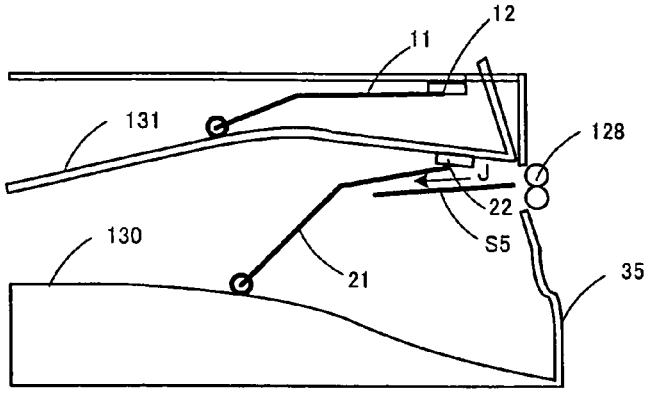
FIGS. 9A to 9D are explanatory views that illustrate a state in which a sheet S5 of a third size smaller than the first size is ejected and stacked in the sheet stacking device according to the fourth embodiment of the present invention.
Figure 9B:
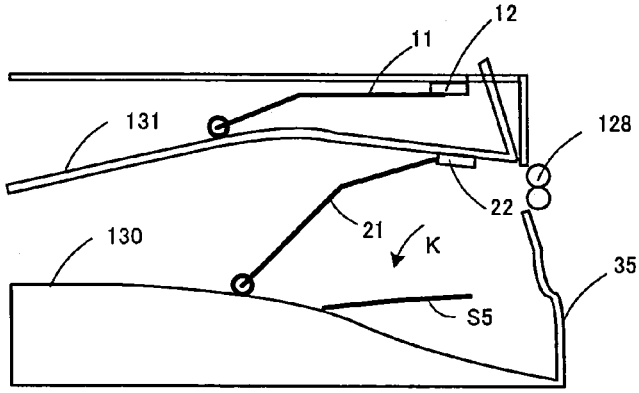
Figure 9C:
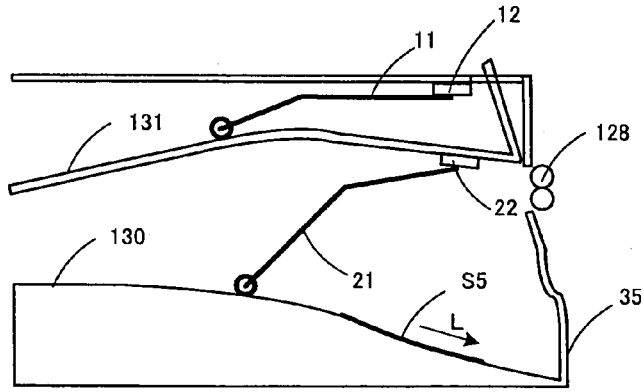
Figure 9D:
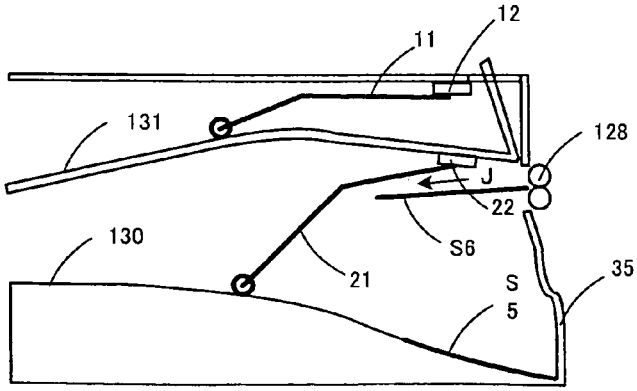
Figure 10A:
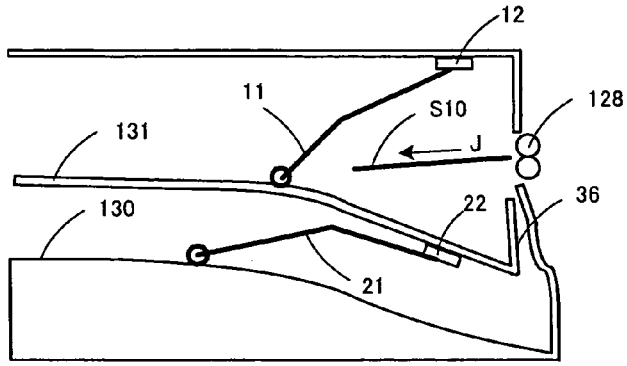
FIGS. 10A to 10D are explanatory views that illustrate a state in which a ejected sheet S10 of the third size is stacked on the second sheet exit tray according to the fourth embodiment of the present invention.
Figure 10B:
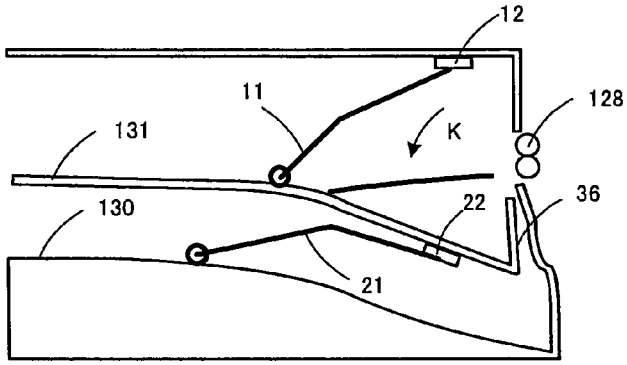
Figure 10C:
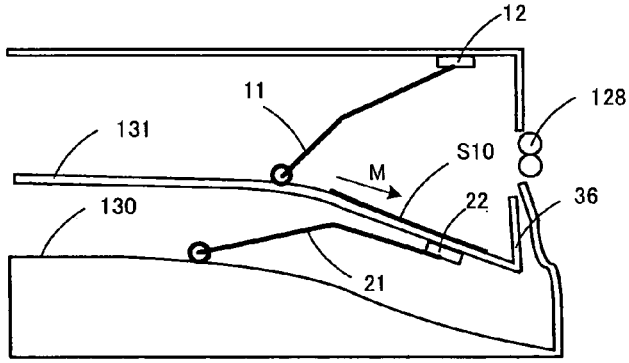
Figure 10D:
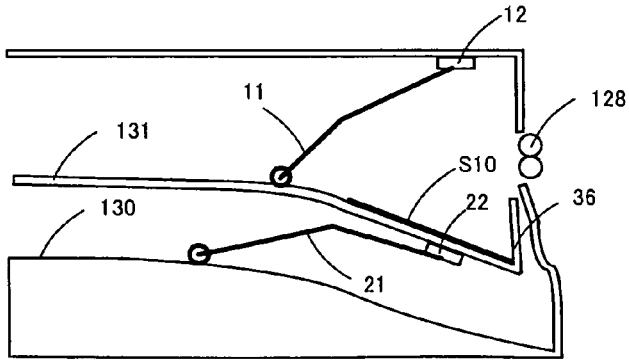

The action of the first sheet exit tray 130 on the sheet of the third size is as follows. A sheet S5 transported while a front end thereof passes through the exit rollers 128 is moved in a direction of an arrow J shown in FIG. 9A while a traveling direction thereof is kept substantially horizontal by the transport force applied from the exit rollers 128 and "stiffness" of the sheet S5 even after the front end passes through the exit rollers 128. A rear end of the sheet S5 separates from the exit rollers 128 in a short time, and the sheet S5 travels substantially in the horizontal direction with the transport speed of the exit rollers 128 set as its initial speed. Since the third size of the sheet S5 is smaller the first size, the sheet S5 is moved forward in a direction of an arrow K shown in FIG. 9B without causing the front end thereof to strike against the sheet presser arm 21 and spontaneously falls downward on the first sheet exit tray 130. Since the first sheet exit tray 130 is inclined, the sheet S5 slides toward an upstream side of the ejection direction indicated by an arrow L by the action of its self-weight as shown in FIG. 9C, strikes against the sheet restricting portion 35 on one end of the first sheet exit tray 130, and stops as shown in FIG. 9D. A sheet S6 ejected next to the sheet S5 is stacked on the sheet S5 on the first sheet exit tray 130 so that one end of the sheet S6 strikes against the sheet restricting portion 35 of the first sheet exit tray 130 through the same process as that of the sheet S5. Thus, the sheets of the third size are orderly stacked on the first sheet exit tray 130.

As described above, the first sheet exit tray 130 is inclined upstream of a portion in which the roller attached to the free end of the arm 21 comes in contact with the first sheet exit tray 130. It is thereby possible to ensure the good stacking performance for the sheets of the third size.

FIGS. 10A to 10D illustrate an instance in which an ejected sheet S10 of the third size is stacked on the second sheet exit tray 131. In this case, similarly to the above, the second sheet exit tray 131 is inclined upstream of a portion in which the roller attached to the free end of the arm 11 comes in contact with the second sheet exit tray 131. It is thereby possible to ensure the good stacking performance for the sheets of the third size.

Seventh Embodiment

As described in the sixth embodiment, the sheet presser arm may be arranged at the position against which the front end of the first size sheet strikes the arm after the rear end of the sheet separates from the exit rollers 128 and travels substantially horizontally. It is convenient if this first size is selectable according to a district in which the sheet stacking device is used or a user utilization situation.

For example, an instance in which the first size is made to correspond to a cross-feed of sheets of a letter size in such a district as the United States where sheets of sizes in order of inches area used, and in which the first size is made to correspond to a cross-feed of sheets of an A4 size in such a district as European countries where sheets of AB sizes are used will be described. In case of the cross-feed for the letter size, a sheet length in the ejection direction is about 216 millimeters. In case of the cross-feed for the A4 size, the sheet length in the ejection direction is 210 millimeters. Accordingly, in the district in which sheets of sizes in inches are used, a distance from the exit rollers to the arm supporting member is set larger than the district in which the sheets of AB sizes are used by six millimeters corresponding to the difference in sheet length. By doing so, it is possible to make the repulsive force applied from the arm to the sheet of the letter size in the district in which the sheets in inches are used, substantially equal to the repulsive force applied from the arm to the sheet of the A4 size in the district in which the sheets of AB sizes are used.

In case of Japan, there are uses who mainly use sheets of the A4 size and users who mainly use sheets of a B5 size. In this case, the first size may be made to correspond to the size of the sheets that each user mainly uses. The sheet of the B5 size has a sheet length in the ejection direction of 182 millimeters, which length is smaller than that of the sheet of the A4 size by 28 millimeters. Accordingly, for the user who mainly uses sheets of the B5 size, the distance from the exit rollers to the arm supporting member may be set smaller than that for the user who mainly uses sheets of the A4 size by 28 millimeters. By so setting, the good stacking performance can be ensured by the action of the sheet presser arm and the sheet exit tray as described in the sixth embodiment for the sheets of the B5 size. In this case, the A4 size is included in the second size larger than the first size. Accordingly, the good stacking performance can be ensured by the action as described in the third embodiment for the sheets of the A4 size.

Figure 12A:
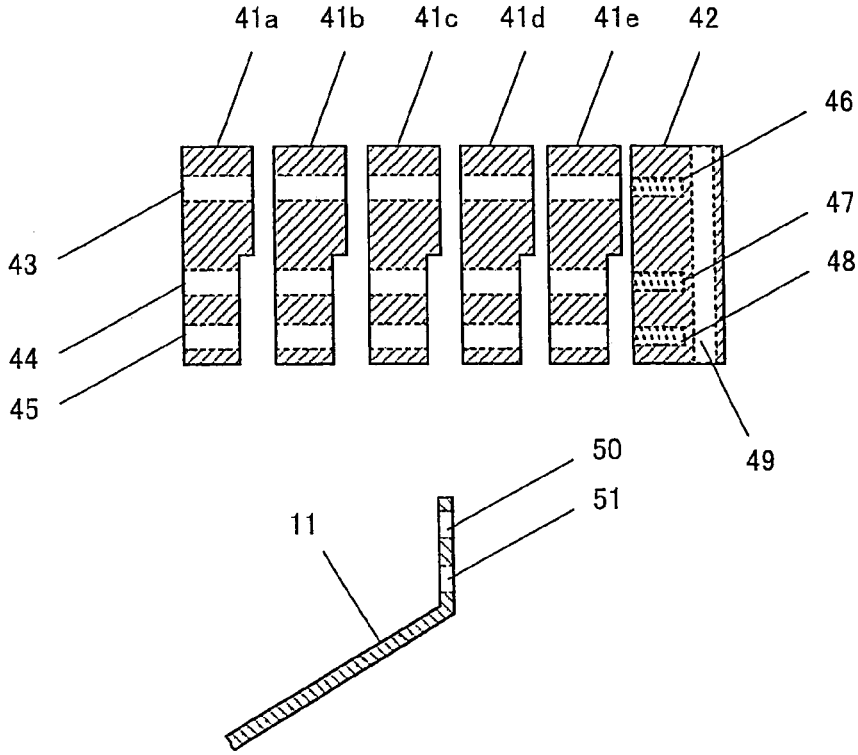
FIGS. 12A and 12B are explanatory views that illustrate one example of an arm supporting member a position of which from exit rollers can be selected according to a sheet size in the sheet stacking device according to the fifth embodiment of the present invention.
Figure 12B:
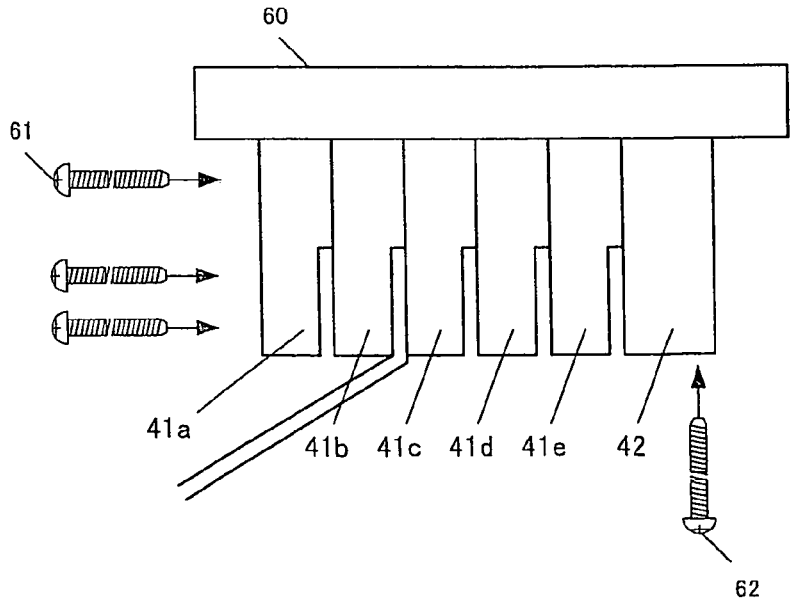

FIGS. 12A and 12B are explanatory views that illustrate one example of the arm supporting member the position of which from the exit rollers can be selected according to the sheet size. FIG. 12A is a sectional view that illustrates detailed sections of respective constituent members 41*a* to 41*e* and 42 of the arm supporting member, and that illustrates a section of a portion of the sheet presser arm 11 supported by the arm supporting member. FIG. 12B illustrates a state in which the respective members are combined.

The members 41*a* to 41*e* are all equal in shape and each includes screw holes 43, 44 and 45 penetrating the member in the horizontal direction. In a state in which the arm supporting member is assembled, all the members 41*a* to 41*e* and 42 are screwed by a screw 61 so as to integrally fix the members by causing the screw 61 to penetrate all the screw holes 43 of the members 41*a* to 41*e* and reach a front end of a screw hole 46 of the member 42. The arm 11 is fixed to the arm supporting member so as to be held between two adjacent members out of the members 41*a* to 41*e* and 42. One fixing screw penetrates the screw holes 44 of the respective members 41*a* to 41*e* and a screw hole 50 of the arm 11 and a front end of the fixing screw reaches a screw hole 47 of the member 42, thereby integrally fixing all the members of the arm supporting member to the arm 11. In addition, another fixing screw penetrates the screw holes 45 of the respective members 41*a* to 41*e* and a screw hole 51 of the arm 11 and a front end of the fixing screw reaches a screw hole 48 of the member 42, thereby integrally fixing all the members of the arm supporting member to the arm 11.

As described above, the arm and the arm supporting member integrally fixed to one another are fixedly screwed by screws 62 from below by an attachment member arranged below the scanner section of the image forming apparatus shown in FIGS. 4A to 4C or below the second sheet exit tray 131.

Figure 13A:
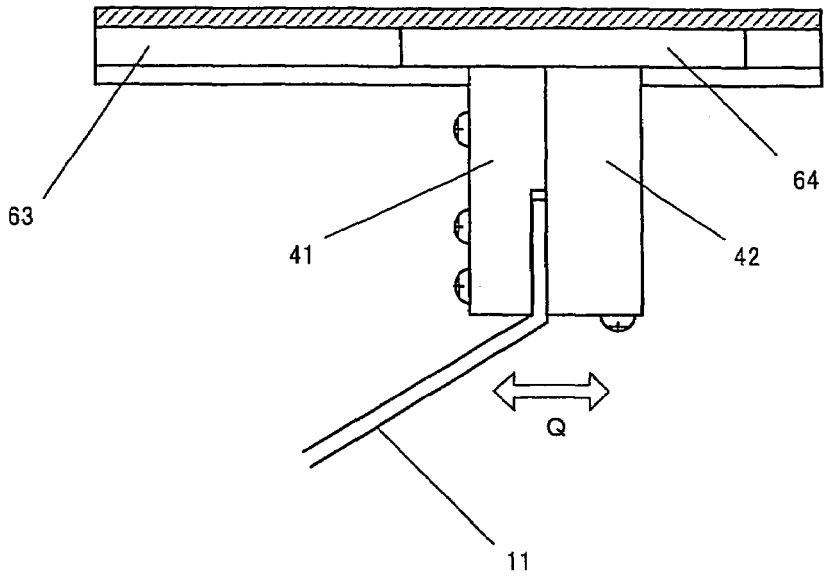
FIGS. 13A and 13B are explanatory views that illustrate another arm supporting member a position of which from the exit rollers can be selected according to the sheet size in the sheet stacking device according to the present invention.
Figure 13B:
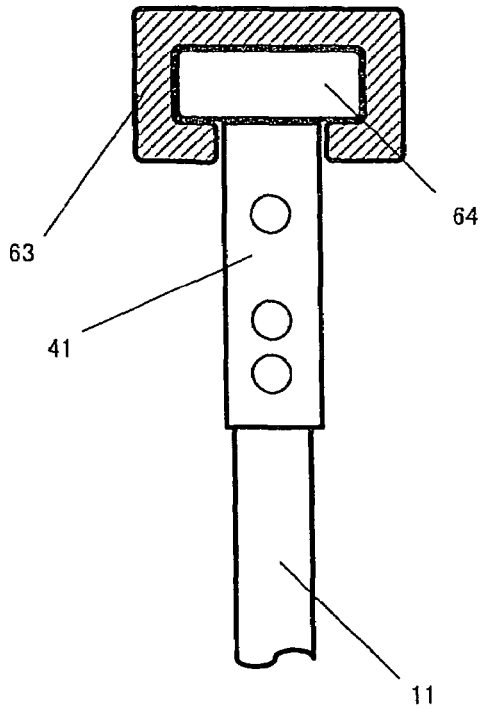

FIGS. 13A and 13B are explanatory views that illustrate another example of the arm supporting member the position of which from the exit rollers can be selected according to the sheet size. A section of a guide rail 63 shown in FIGS. 13A and 13B orthogonal to a sliding direction has a shape that includes an opening in a central portion of a lower side of a rectangle as shown in FIG. 13B. A sliding member 64 is moved in the guide rail 63, and arm supporting members 41 and 42 and the arm 11 attached integrally with the sliding member 64 are moved in a direction of an arrow Q shown in FIG. 13A along the guide rail 63. While a supported end of the arm 11 can be moved to an appropriate position of the guide rail 63, it is held at a predetermined position by a frictional force between the guide rail 63 and the sliding ember 64.

By employing the mechanism shown in FIGS. 12A and 12B or FIGS. 13A and 13B, the arm can be arranged at an optimum position according to the sheet size. Although the user can select the position of the arm, the present invention is not limited to this. The arm may be arranged at a position according to a destination district during shipping of the product from a factory or a service engineer may determine the arrangement of the arm according to a machine installation environment.

Figure 11A:
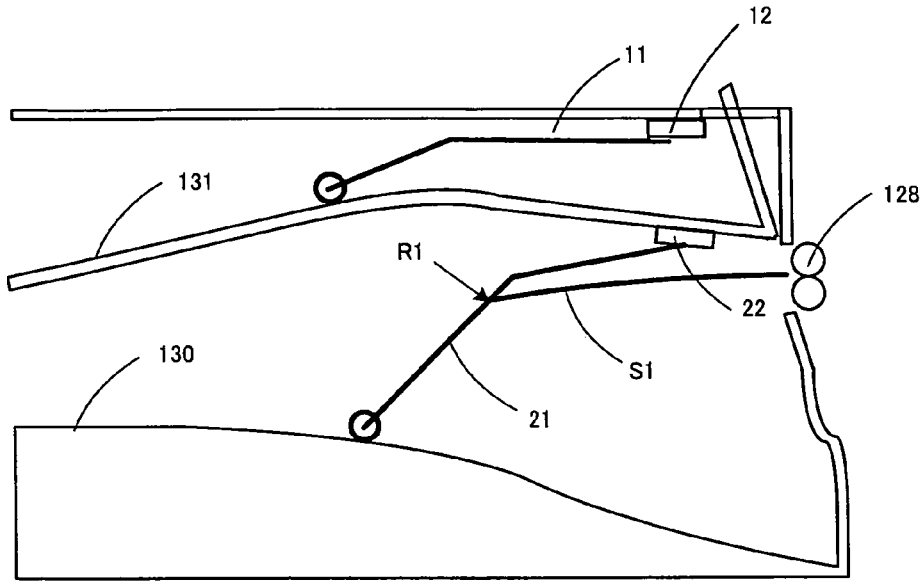
FIGS. 11A and 11B are explanatory views that illustrate a state in which an arm 21 is arranged at an optimum position for sheets of size A4 and size B5, respectively, according to the fourth embodiment of the present invention.
Figure 11B:
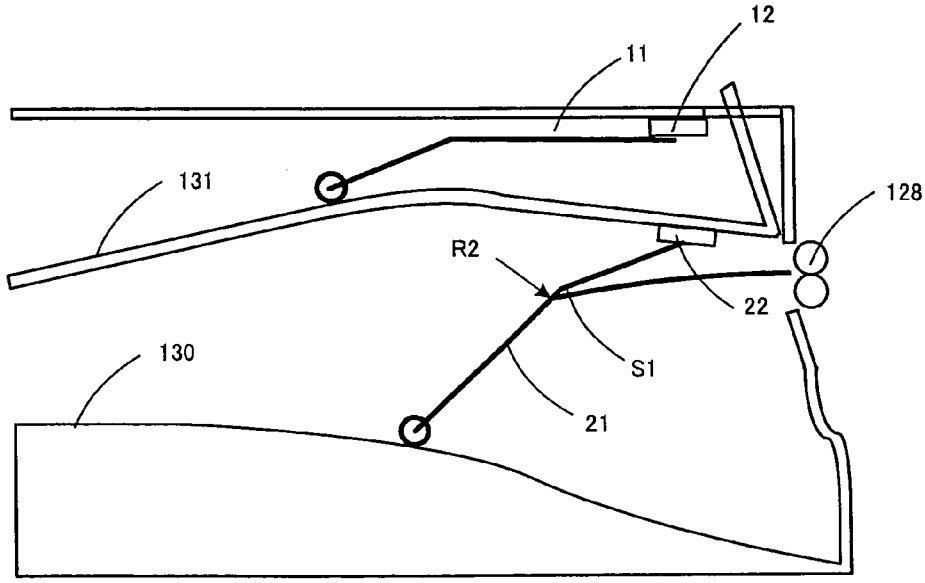

FIGS. 11A and 11B are explanatory views that illustrate states in which the arm is arranged at optimum positions for the sheet of the A3 size and the sheet of the B5 size, respectively. FIG. 11A illustrates the optimum position of the arm 21 for the sheet of the A4 size and FIG. 11B illustrates the optimum position of the arm for the sheet of the B5 size.

Referring to FIG. 11A, if a shortest distance between a point R1 at which the sheet of the A4 size strikes against the arm 21 and the exit rollers 128 is assumed as Lr1, the following relationship is satisfied.

$$210(\mathrm{mm}) < Lr1(\mathrm{mm}) \leqq 210 + d(\mathrm{mm})$$

In this expression, d denotes a distance by which a rear end of the sheet separates from the exit rollers 128 and the sheet moves in space substantially horizontally at the transport speed of the exit rollers 128 set as its initial speed.

Referring to FIG. 11B, if a shortest distance between a point R2 at which the sheet of the B5 size strikes against the arm 21 and the exit rollers 128 is assumed as Lr2, the following relationship is satisfied.

$$182(\mathrm{mm}) < Lr2(\mathrm{mm}) \leqq 182 + d(\mathrm{mm})$$

Eighth Embodiment

Figure 14:
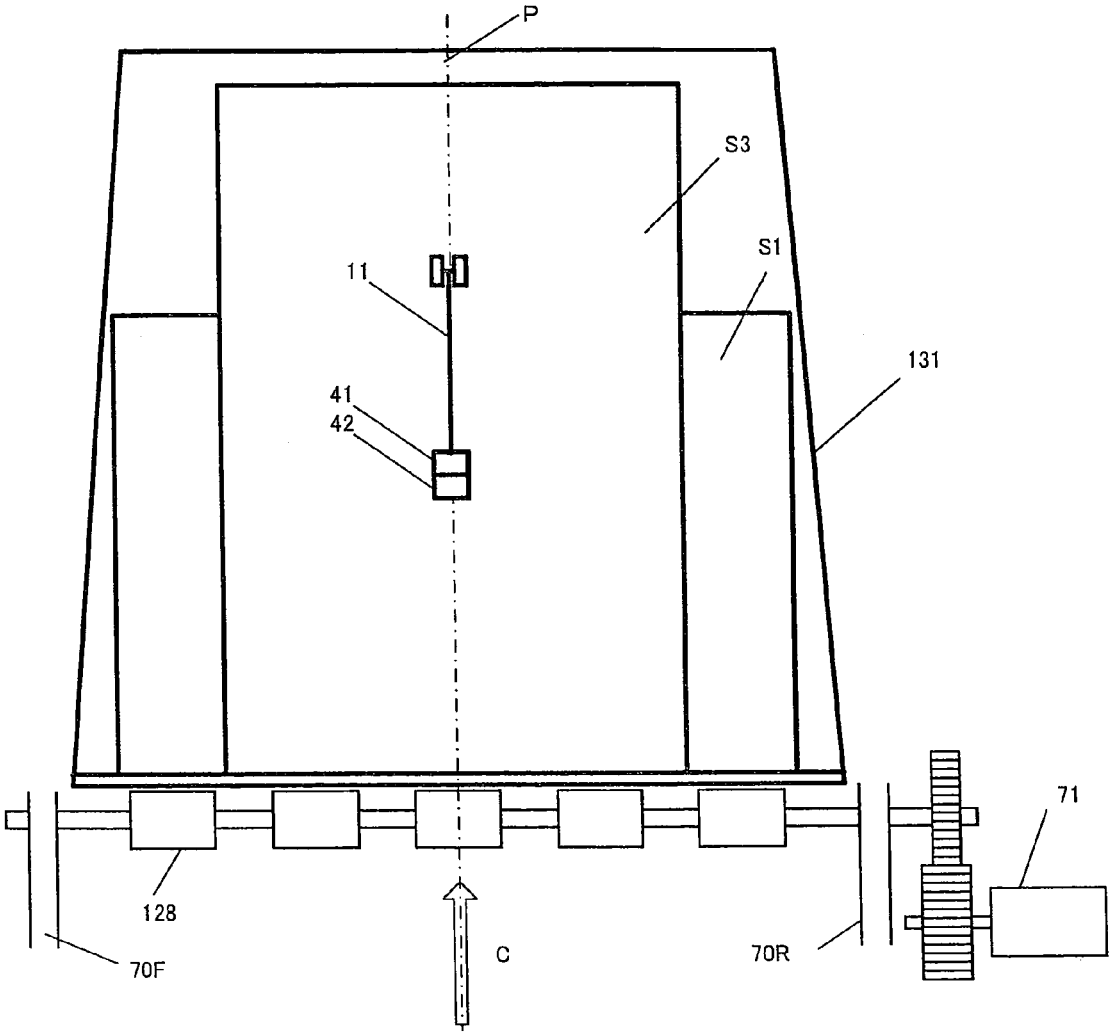
FIG. 14 is an explanatory view that illustrates one example of arrangement of sheets and the sheet presser arm in the sheet stacking device when the second sheet exit tray is viewed from above according to an eighth embodiment of the present invention.

FIG. 14 is an explanatory view that illustrates one example of arrangement of sheets and the sheet presser arm when the second sheet exit tray 131 is viewed from above. As shown in FIG. 14, sheets of different sizes are ejected so that a center of a side of each sheet orthogonal to the ejection direction is aligned on the same line P. The sheet presser arm 11 is arranged so that the center thereof coincides with a center of the line P. The roller attached to the free end of the arm 11 is arranged at an equidistant position from the arm 11 on each side of the arm 11. By doing so, forces of the rollers for pressing the respective sheets are kept in balance about the line P and the traveling direction of the sheets is kept parallel to the line P.

FIG. 14 illustrates an instance in which the number of the arms 11 is one. If a plurality of arms are arranged, for example, even-numbered arms are arranged, each pair of arms are arranged at symmetric positions about the line P so that the forces of the rollers for pressing the respective sheets are kept in balance about the line P and so that the traveling direction of the sheet is kept parallel to the line P. If odd-numbered arms are arranged, then one of the arms is arranged so that a center of the line P coincides with that of the arm, and each pair of the remaining even-numbered arms are arranged at symmetric positions about the line P as shown in FIG. 14.

By thus arranging the arm, the repulsive force applied to front ends of sheets of a size larger than the first size when the front ends strike against the arm is expected to be symmetric about the line P.

By thus arranging the arm, the repulsive force is applied to each sheet from the arm laterally symmetric about a central point at which the size of the front end of the sheet crosses the line P. Due to this, a force for deviating the sheet to a direction orthogonal to the ejection direction does not act on the sheet.

It is, therefore, possible to ensure the good stacking performance for the direction orthogonal to the sheet ejection direction.

Ninth Embodiment

Figure 15A:
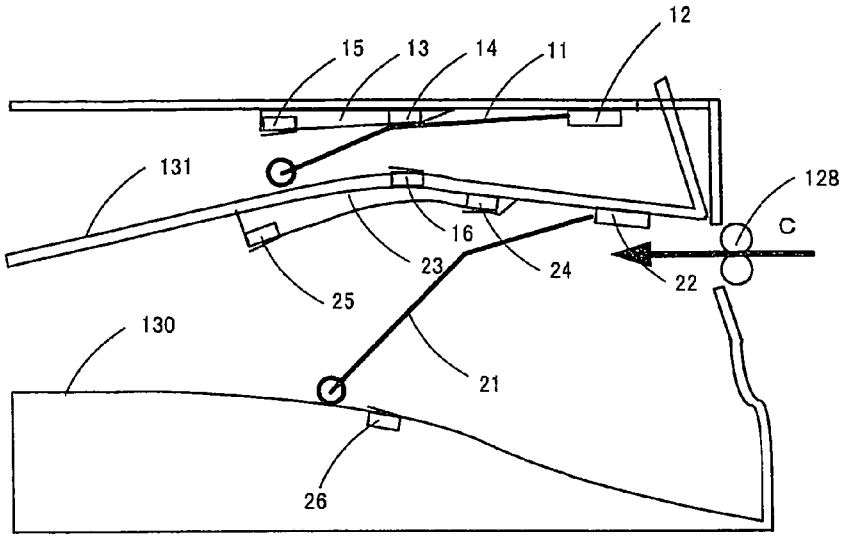
FIGS. 15A to 15C are explanatory views that illustrate an example of the configuration of the sheet stacking device according to a ninth embodiment of the present invention.
Figure 15B:
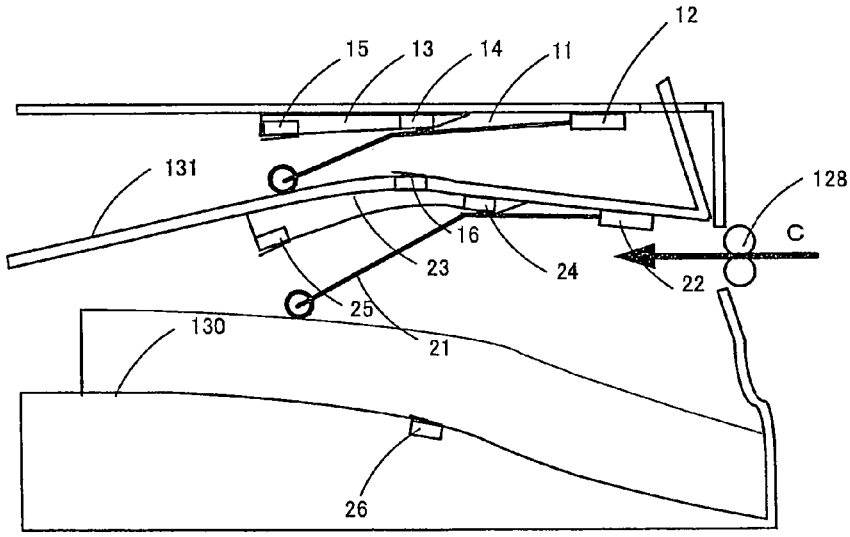
Figure 15C:
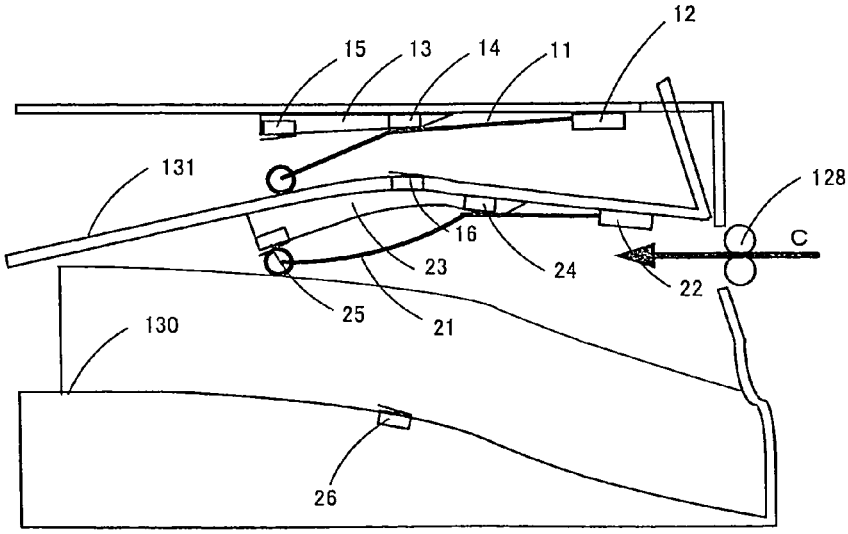

FIGS. 15A to 15C are explanatory views that illustrate an example of the configuration of the sheet stacking device according to a ninth embodiment. FIGS. 15A to 15C show that the sheet stacking device stacks sheets ejected from the exit rollers 128 in a direction of an arrow C on the first sheet exit tray 130. FIG. 15A shows a state in which no sheet is stacked on the first sheet exit tray 130, in which state the free end of the sheet presser arm 21 is in contact with the first sheet exit tray 130 via the roller attached to the free end. If sheets are ejected and stacked on the first sheet exit tray 130, the free end of the arm 21 rises by the stacked sheets. A material for the arm 21 is, for example, a phosphor bronze flat plate and exhibits flexibility. Due to this, the arm 21 flexes near a bend as the free end thereof rises. If the sheet stacked amount increases, the bend of the arm 21 abuts on the flexure restricting portion 23. The tray-full prediction sensor 24 using, for example, a micro-switch is provided in a portion in which the bend of the arm 21 abuts on the flexure restricting portion 23. If the bend of the arm 21 presses an actuator provided on the sensor 24, the sensor 24 detects this and outputs a tray-full prediction signal. FIG. 15B illustrates a state in which the bend of the arm 21 rises and abuts on the flexure restricting portion 23 and in which the tray-full prediction sensor 24 outputs the tray-full prediction signal. In this state, if the sheet stacked amount further increases, the free end side of the arm 21 flexes rather than the bend and the free end rises. The roller attached to the free end abuts on the flexure restricting portion 23. The tray-full detection sensor 25 using, for example, a micro-switch is provided in a portion in which the roller on the free end of the arm 21 abuts on the flexure restricting portion 23. The sensor 25 detects this and outputs a tray-full detection signal. FIG. 15C illustrates a state in which the free end of the arm 21 rises and in which the tray-full detection sensor 25 outputs the tray-full detection signal.

Figure 16A:
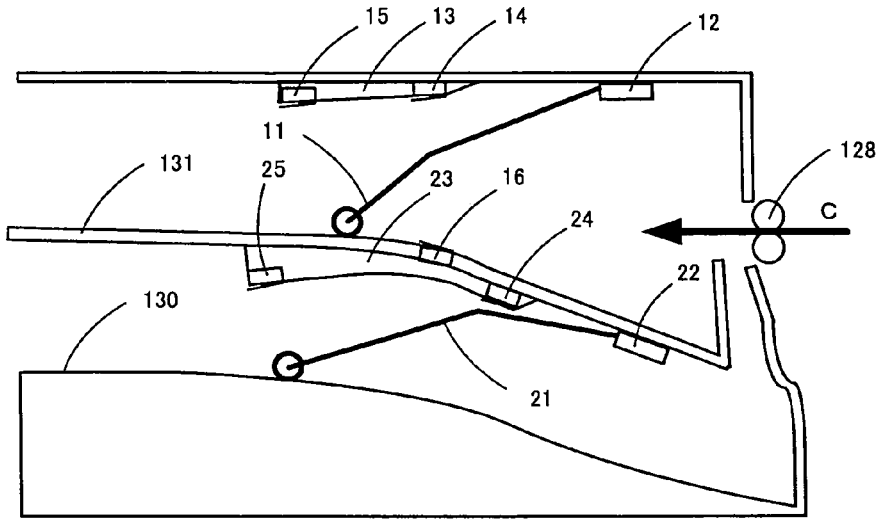
FIGS. 16A to 16C are explanatory views that illustrate a different state of the sheet stacking device according to the ninth embodiment of the present invention.
Figure 16B:
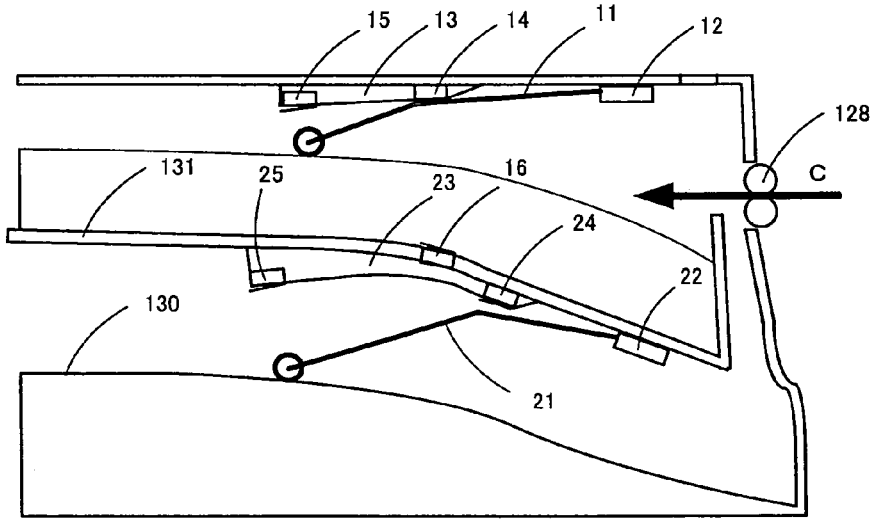
Figure 16C:
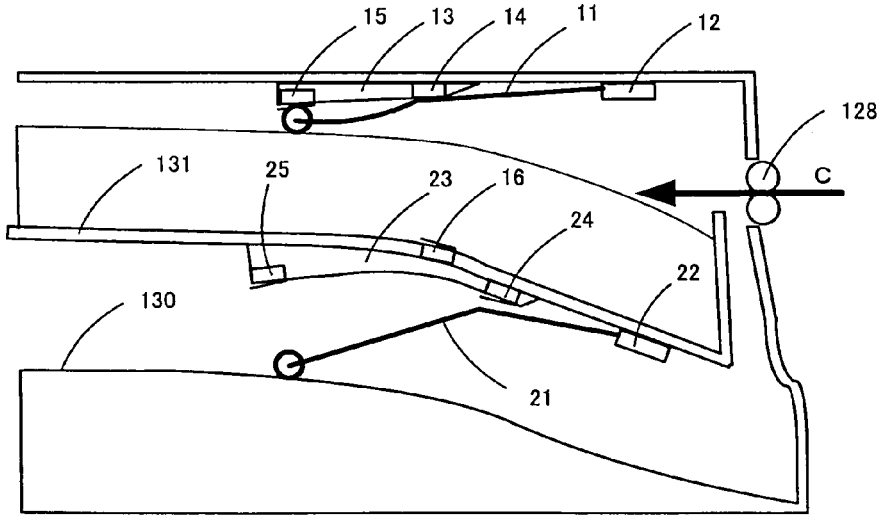

FIGS. 16A to 16C are explanatory views that illustrate a different state of the sheet stacking device according to this embodiment. In FIGS. 16A to 16C, the ejected sheets are stacked on the second sheet exit tray 131. FIG. 16A illustrates a state in which no sheet is stacked on the second sheet exit tray 131, in which state the free end of the sheet presser arm 11 is in contact with the second sheet exit tray 131 via the roller attached to the free end. If sheets are ejected and stacked on the second sheet exit tray 131, the free end of the arm 11 rises by the stacked sheet. A material for the arm 11 is, for example, a phosphor bronze flat plate and exhibits flexibility. Due to this, the arm 11 flexes near a bend as the free end thereof rises. If the sheet stacked amount increases, the bend of the arm 11 abuts on the flexure restricting portion 13 in a short time. The tray-full prediction sensor 14 using, for example, a micro-switch is provided in a portion in which the bend of the arm 11 abuts on the flexure restricting portion 13. If the bend of the arm 11 presses an actuator provided on the sensor 14, the sensor 14 detects this and outputs a tray-full prediction signal. FIG. 16B illustrates a state in which the bend of the arm 11 rises and abuts on the flexure restricting portion 13 and in which the tray-full prediction sensor 14 outputs a tray-full prediction signal. In this state, if the sheet stacked amount further increases, the bend of the arm 11 does not rise since the bend abuts on the flexure restricting portion 13. Instead, the free end side of the arm 11 flexes rather than the bend and the free end rises. The roller attached to the free end abuts on the flexure restricting portion 13. The tray-full detection sensor 15 using, for example, a micro-switch is provided in a portion in which the roller on the free end of the arm 11 abuts on the flexure restricting portion 13. The sensor 15 detects this and outputs a tray-full detection signal. FIG. 16C illustrates a state in which the free end of the arm 11 rises and in which the tray-full detection sensor 15 outputs the tray-full detection signal.

In this embodiment, the sheet stacking device that includes the first and the second sheet exit trays has been described. Alternatively, the sheet stacking device may be configured to include only one sheet exit tray. The sheet presser arm consisting of a bent elastic member, the flexure restricting portion, and the two sensors can perform the tray-full prediction and the tray-full detection.

Tenth Embodiment

In a tenth embodiment, an instance in which the sheet presser arm includes a plurality of bends and in which the sheet stacking device includes a plurality of tray-full prediction sensors corresponding to the respective bends will be described.

Figure 18A:
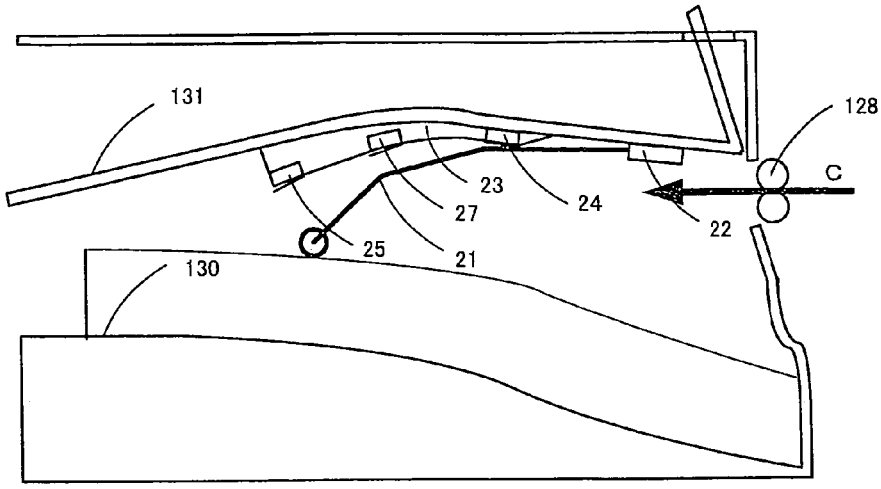
FIGS. 18A to 18C are explanatory views that illustrate that the sheet presser arm of the sheet stacking device includes two bends according to a tenth embodiment of the present invention.
Figure 18B:
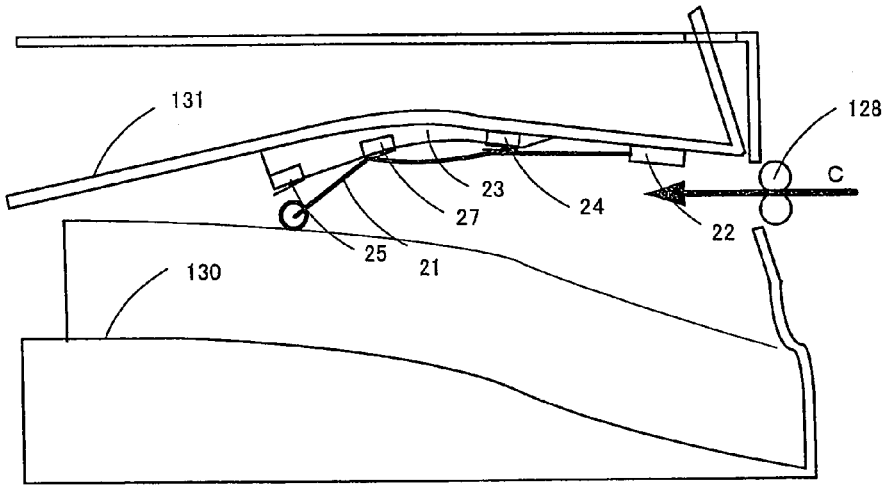
Figure 18C:
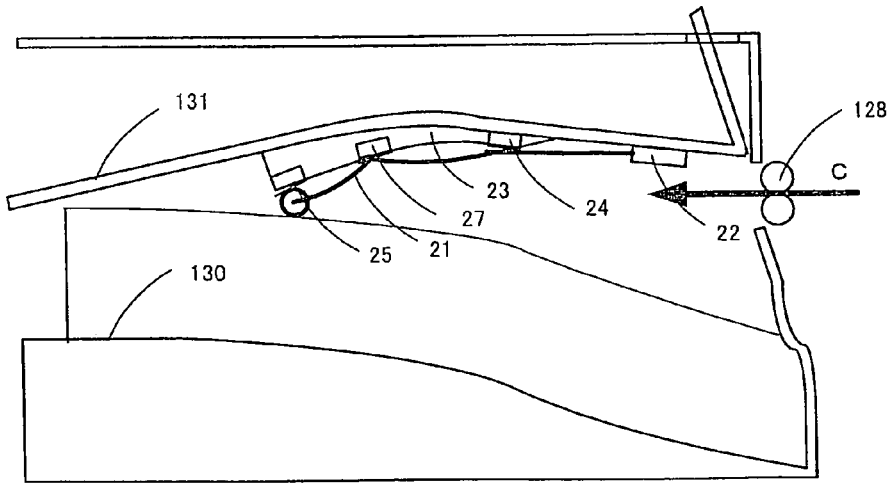

FIGS. 18A to 18C are explanatory views that show that the sheet presser arm includes two bends in the sheet stacking device according to the present invention. A first tray-full prediction sensor 24 and a second tray-full prediction sensor 27 are arranged to correspond to the respective bends of the arm 21. For brevity, FIGS. 18A to 18C show only the sensors on the first sheet exit tray 130. If sheets are ejected and stacked on the first sheet exit tray 130, the free end of the arm 21 rises by the stacked sheets. The arm 21 flexes near the bends as the free end thereof rises. If the sheet stacked amount increases, the bend of the arm 21 closest to the supported end abuts on the flexure restricting portion 23. The first tray-full prediction sensor 24 is provided in a portion in which the bend abuts on the flexure restricting portion 23. If the bend of the arm 21 presses an actuator provided on the sensor 24, the sensor 24 detects this and outputs a first tray-full prediction signal. FIG. 18A illustrates a state in which the first tray-full prediction sensor 24 outputs the first tray-full prediction signal.

In this state, if the sheet stacked amount further increases, the bend of the arm 21 on the supported portion side does not rise since the bend abuts on the flexure restricting portion 23. Instead, the free end side of the arm 21 flexes rather than the bend which abuts on the first tray-full prediction sensor 24 and the free end of the arm 21 rises. The bend on the free end side abuts on the flexure restricting portion 23. The second tray-full prediction sensor 27 is provided in a portion in which the bend on the free end side of the arm 21 abuts on the flexure restricting portion 23. The sensor 27 detects this and outputs a second tray-full prediction signal. FIG. 18B illustrates a state in which the second tray-full prediction sensor 27 outputs the second tray-full prediction signal.

In this state, if the sheet stacked amount further increases, the two bends of the arm 21 do not rise since the bends abuts on the flexure restricting portion 23. Instead, the arm 21 flexes between the free end-side bend of the arm 21 and the free end thereof and the free end rises. The roller attached to the free end abuts on the flexure restricting portion 23. The tray-full detection sensor 25 using, for example, a micro-switch is provided in a portion in which the roller on the free end of the arm 21 abuts on the flexure restricting portion 23. The sensor 25 detects this and outputs a tray-full detection signal. FIG.

18C illustrates a state in which the free end of the arm 21 rises and in which the tray-full detection sensor 25 outputs the tray-full detection signal.

As can be understood, using the configuration in which the sheet presser arm includes a plurality of bends, multiple stages of the tray-full prediction can be performed.

Eleventh Embodiment

In an eleventh embodiment, an instance in which the sheet presser arm is curved will be described.

Figure 19A:
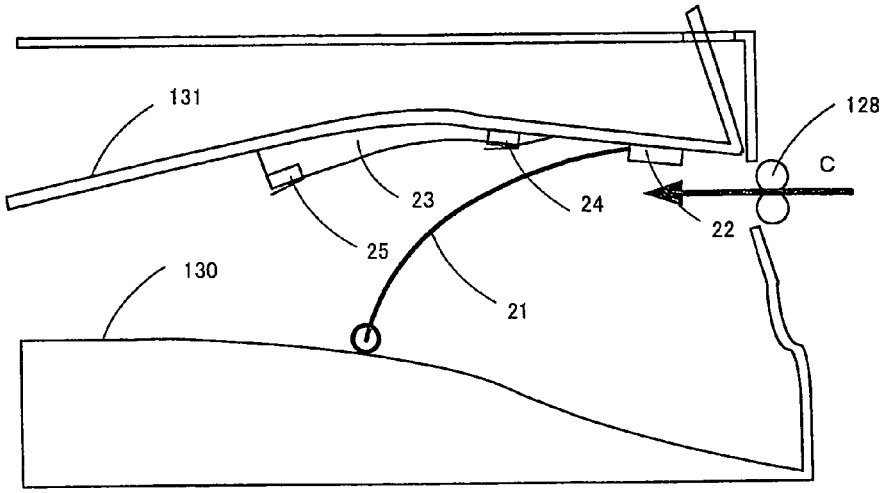
FIGS. 19A to 19C are explanatory views that illustrate that the sheet presser arm of the sheet stacking device is curved according to an eleventh embodiment of the present invention.
Figure 19B:
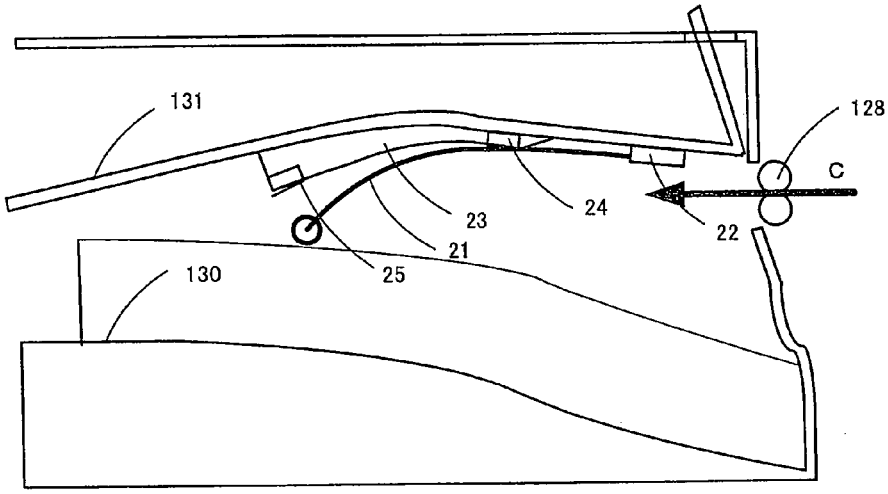
Figure 19C:
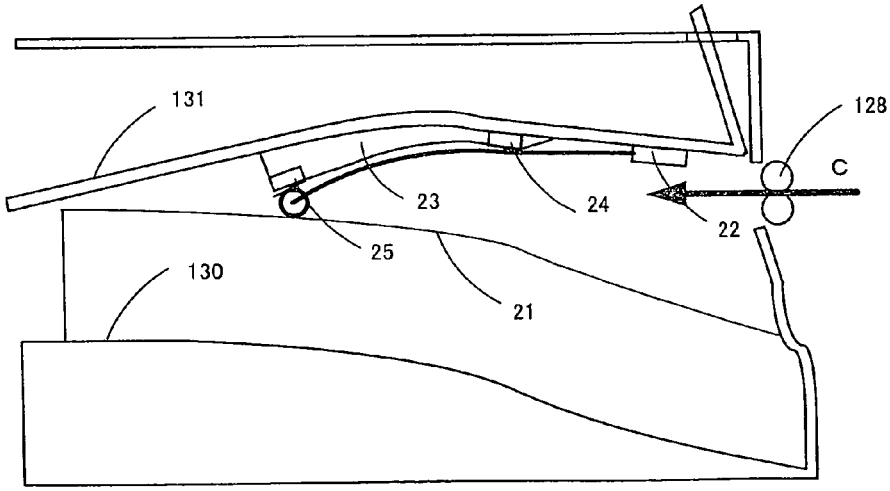

FIGS. 19A to 19C are explanatory views that illustrate an instance in which the sheet presser arm is curved in the sheet stacking device according to the present invention. For brevity, FIGS. 19A to 19C show only the sensors on the first sheet exit tray 130. FIG. 19A illustrates a state in which no sheet is stacked on the first sheet exit tray 130, in which state the free end of the sheet presser arm 21 is in contact with the first sheet exit tray 130 via the roller attached to the free end. If sheets are ejected and stacked on the first sheet exit tray 130, the free end of the arm 21 rises by the stacked sheets. The arm 21 flexes near a curved portion as the free end thereof rises. If the sheet stacked amount increases, the supported end-side curved portion of the arm 21 abuts on the flexure restricting portion 23. The tray-full prediction sensor 24 and the tray-full detection sensor 25 are provided in portions in which the arm 21 abuts on the flexure restricting portion 23, respectively, and the tray-full prediction sensor 24 is arranged on the supported end side of the arm 21. If the curved portion of the arm 21 rises as the free end thereof rises, the tray-full prediction sensor 24 first detects that the arm 21 abuts on the flexure restricting portion 23 and outputs the tray-full prediction signal. FIG. 19B illustrates a state in which the tray-full prediction sensor 24 outputs the tray-full prediction signal.

In this state, if the sheet stacked amount further increases, then the arm 21 flexes between the free end-side cured portion and the free end of the arm 21, and the free end of the arm 21 rises. The roller on the free end abuts on the flexure restricting portion 23. The tray-full detection sensor 25 is provided in the portion in which the roller on the free end of the arm 21 abuts on the flexure restricting portion 23. The sensor 25 detects the abutment of the free end of the arm 21 on the flexure restricting portion 23 and outputs the tray-full detection signal. FIG. 19C illustrates a state in which the tray-full detection sensor 25 outputs the tray-full detection signal.

As can be understood, using the configuration in which the sheet presser arm includes a plurality of bends, multiple stages of the tray-full prediction can be performed.

In this embodiment, the instance in which one tray-full prediction sensor and one tray-full detection sensor are provided has been described. Alternatively, as described in the tenth embodiment, a plurality of tray-full prediction sensors may be arranged to perform multiple stages of the tray-full prediction.

Twelfth Embodiment

As shown in FIGS. 15A to 15C and 16A to 16C, if the second sheet exit tray 131 is a movable tray, it is necessary to execute an initialization operation for determining an absolute position of the tray 131 and arranging the tray 131 at a predetermined position after, for example, the sheet stacking device is turned on. It is also necessary that the second sheet exit tray 131 does not exceed a vertical movable range during the initialization operation. To realize this, a sensor that detects that the sheet exit tray 131 is located at an upper limit position or a lower limit position in the movable range needs to be provided. The absolute position of the sheet exit tray 131 can be determined by detecting that the sheet exit tray 131 is located at the lower limit position or the upper limit position and obtaining a movement distance thereafter. If the sheet exit tray 131 is driven by, for example, a stepping motor, the absolute position can be obtained by positively or negatively counting the number of movement steps from the upper limit position or the lower limit position according to a movement direction. Alternatively, the absolute position may be obtained by attaching an encoder to a shaft of a driving motor and subjecting the number of pulses of the encoder to addition or subtraction according to the movement direction.

While dedicated sensors for the upper limit position and the lower limit position may be provided to detect the respective positions, the structure can be simplified if the tray-full prediction sensor or the tray-full detection sensor is used therefore.

Figure 17A:
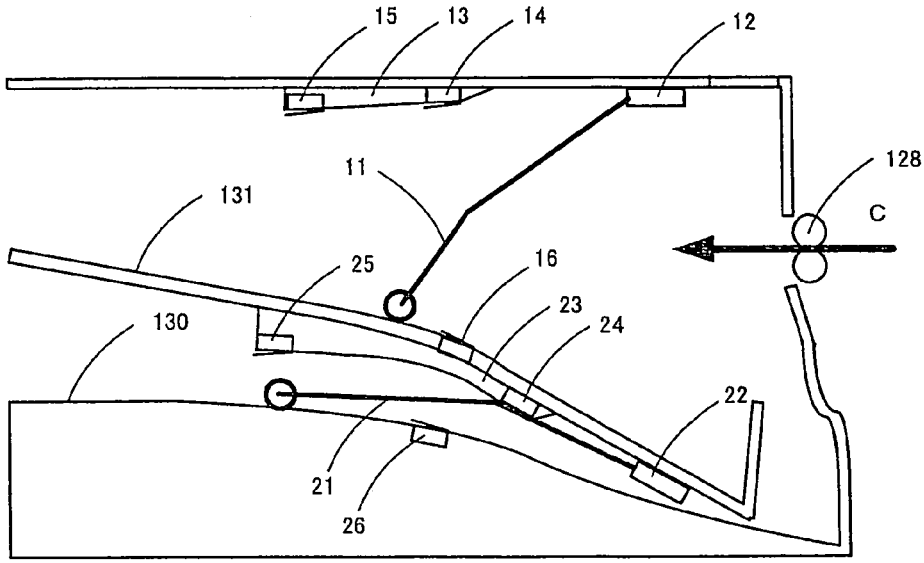
FIGS. 17A and 17B are explanatory views that illustrate states of a tray-full prediction sensor and a tray-full detection sensor at an upper limit position and a lower limit position if the upper and lower limit positions of the second sheet exit tray are detected by the tray-full prediction sensor and the tray-full detection sensor, respectively, according to a twelfth embodiment of the present invention.
Figure 17B:
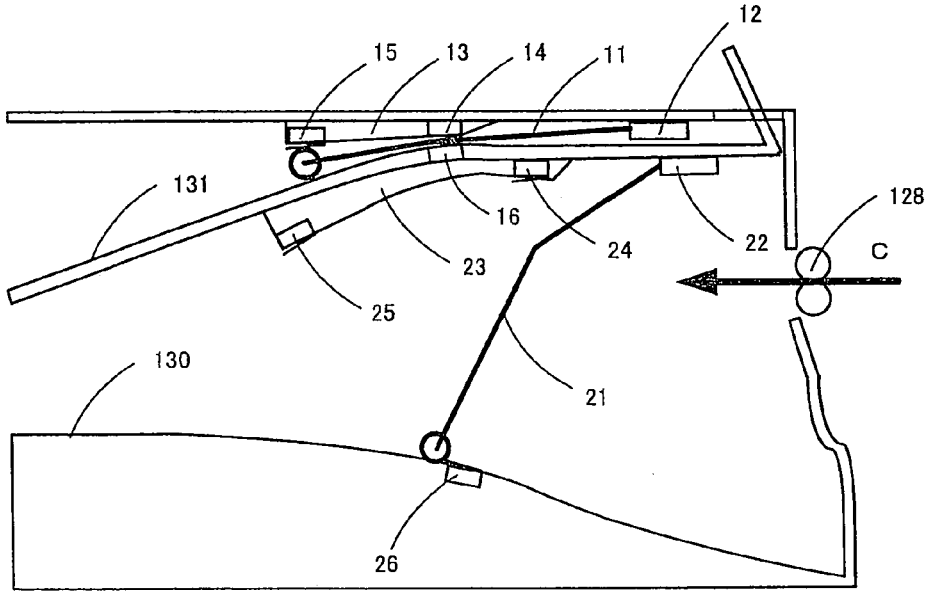

FIGS. 17A and 17B are explanatory views that illustrate states of the sensors at the upper limit position and the lower limit position of the second sheet exit tray 131 if the tray-full prediction sensor and the tray-full detection sensor are used to detect the upper limit position and the lower limit position. FIG. 17A illustrates a state in which the second sheet exit tray 131 is located at the lower limit position. If the tray 131 is at the lower limit position, then the roller on the free end of the sheet presser arm 21 is pressed by the first sheet exit tray 130, and the bend of the arm 21 turns on the tray-full prediction sensor 24. In a tray initialization state, the tray-full prediction sensor 24 is turned off and the tray 131 is moved downward. When the state of the sensor 24 is changed to be turned on, the tray-full prediction sensor 24 can detect that the tray 131 is at the lower limit position.

In this case, if sheets are stacked on the first sheet exit tray 130, the absolute position of the second sheet exit tray 131 cannot be accurately detected. Therefore, if a failure-to-fetch-sheets sensor 26 is installed and the sensor 26 detects the presence of sheets, the sensor 26 may notify the user of the failure to fetch sheets and urge the user to remove the sheets from the first sheet exit tray 130 before the initialization operation. By doing so, one sensor can function as both the tray-full prediction sensor and the tray lower limit sensor.

FIG. 17B illustrates a state in which the second sheet exit tray 131 is at the upper limit position. If the tray 131 is at the upper limit position, the roller on the free end of the arm 21 raised by the second sheet exit tray 131 from below turns on the tray-full detection sensor 15. In the tray initialization state, the tray-full detection sensor 15 is turned off and the tray 131 is moved upward. When the state of the sensor 15 is changed to be turned on, the sensor 15 can detect that the tray 131 is at the upper limit position.

In this case, if sheets are stacked on the second sheet exit tray 131, the absolute position of the second sheet exit tray 131 cannot be accurately detected. Therefore, if a failure-to-fetch-sheets sensor 16 is installed and the sensor 16 detects the presence of sheets, the sensor 16 may notify the user of the failure to fetch sheets and urge the user to remove the sheets from the second sheet exit tray 131 before the initialization operation. By doing so, one sensor can function as both the tray-full detection sensor and the tray upper limit sensor.

The present invention is not limited to this embodiment. The lower limit position of the tray 131 can be detected by the tray-full detection sensor 25 or the upper limit position thereof can be detected by the tray-full prediction sensor 14. These techniques may be appropriately selected according to shapes and the like of the trays and the arms as is obvious to a person having ordinary skill in the arm.

Thirteenth Embodiment

In a thirteenth embodiment, an instance in which information based on a stacking height of the stacked sheets detected by the tray-full prediction sensor or the tray-full detection sensor, the upper limit position of the movable tray or the lower limit position of the flexure restricting portion is displayed will be described. In addition, a technique for regularly making the movable tray or the flexure restricting portion closer to the sheet exit tray by a predetermined distance during an interval of the sheet eject, detecting states of the tray-full prediction sensor and the tray-full detection sensor, and performing multiple stages of the tray-full prediction and the tray-full detection will be described.

If the tray-full detection sensor detects that the sheets are full on the sheet exit tray as described in the tenth to twelfth embodiments, the sheet eject may be stopped so as to prevent further sheets from being ejected to the sheet exit tray. To this end, the user should remove the sheets stacked on the sheet exit tray by hands. This is because a new sheet cannot be ejected until the sheets are removed from the sheet exit tray. It is, therefore, preferable to provide the sheet stacking device with means for notifying the user that the sheets are full on the sheet exit tray and indicating the user to remove the sheets stacked on the sheet exit tray. Particularly in the sheet stacking device included in the image forming apparatus that includes the scanner section above the sheet exit tray as shown in FIG. 2, the sheet exit tray is often hidden by the scanner section to make it difficult to observe the state of the stacked sheets. This is why the sheet stacking device preferably includes the notification means for notifying the user of the state. In this case, if the user is simply notified the tray-full state, the user is urged to remove the sheets after the sheets cannot be ejected in vain. It is rather preferable to notify the user of the state before the stacked sheets are full on the sheet exit tray, that is, the tray-full prediction. By doing so, it is expected that the sheets are removed before the sheets are full on the sheet exit tray and that the processing can be continuously performed without intermission due to the tray-full state.

In the tenth to twelfth embodiments, the tray-full prediction sensor as well as the tray-full detection sensor is provided. It is, therefore, possible to urge the user to remove the sheets before the sheets are full on the sheet exit tray. Further, if multiple stages of the tray-full prediction, the tray-full prediction, and the failure-to-fetch-sheets detection are performed, it is possible to notify the user of the state of the sheet exit tray in more detail.

Figure 21B:
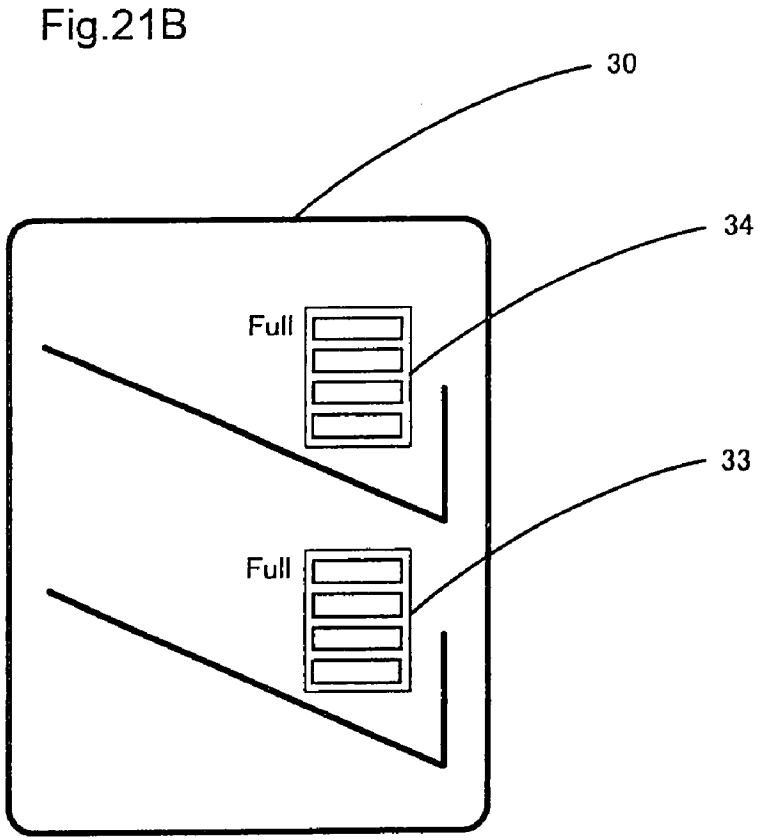
FIGS. 21A and 21B are explanatory views that illustrate one example of a display section that notifies a user of states of the sheet exit trays according to the thirteenth embodiment of the present invention.
Figure 21A:
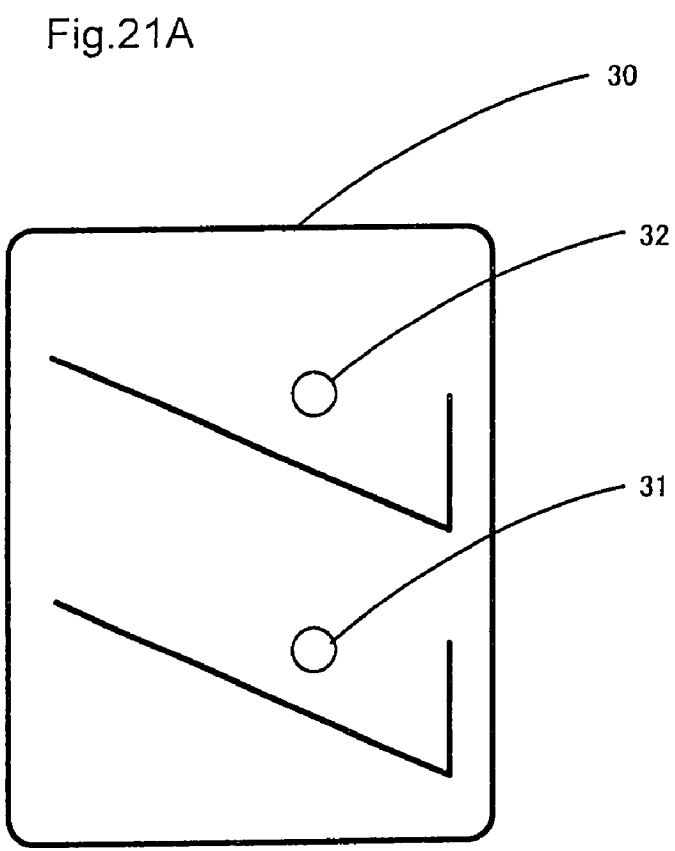

FIGS. 21A and 21B are explanatory views that illustrate one example of a display section that notifies the user of states of the sheet exit trays. FIGS. 21A and 21B correspond to the sheet stacking device having the job separator shown in FIG. 2. FIG. 21A illustrates an instance of performing one stage of the tray-full prediction and the tray-full detection. A display section 30 includes a display lamp 31 that displays a sheet stacking state of the lower first sheet exit tray 130 and a display lamp 32 that displays a sheet stacking state of the upper second sheet exit tray 131. Each of the display lamps 31 and 32 is switched on in a tray-full prediction state and switched on and off in a tray-full detection state. The display lamps 31 and 32 are turned off in the other states.

As shown in FIG. 15A, for example, if no sheets are stacked on both the first sheet exit tray 130 and the second sheet exit tray 131, the display lamps 31 and 32 are both turned off. If the ejected sheets are stacked on the first sheet exit tray 130 and the tray-full prediction sensor 24 is turned on as shown in FIG. 15B, the display lamp 31 is switched on in response to the ON-state of the sensor 24. If sheets are further stacked on the first sheet exit tray 130 and the tray-full detection sensor 25 is turned on as shown in FIG. 15C, then the display lamp 31 is changed over to be switched on and off from the ON-state and the eject of the further sheets is stopped. If the user notices that the display lamp 31 is switched on and off and removes the sheets from the first sheet exit tray 130, and the sheet stacking device is turned into the state shown in FIG. 15A, the display lamp 31 is turned off. Namely, if both the tray-full prediction sensor 24 and the tray-full detection sensor 25 are turned off while the sheets are stacked on the first sheet exit tray 130, the display lamp 31 is turned off. If only the tray-full prediction sensor 24 is turned on and the tray-full detection sensor 25 is turned off, the display lamp 31 is switched on. If both the tray-full prediction sensor 24 and the tray-full detection sensor 25 are turned on, the display lamp 31 is switched on and off. By thus controlling the display of the display lamp 31 for the states of the tray-full prediction sensor 24 and the tray-full detection sensor 25, the user can be notified of the tray-full prediction and the tray-full state.

In FIGS. 15A to 15C, to stack the ejected sheets on the first sheet exit tray 130, the second sheet exit tray 131 is arranged upward. In this state, the tray-full prediction sensor 14 and the tray-full detection sensor 15 cannot detect the sheet stacking state of the second sheet exit tray 131. However, since the ejected sheets are not stacked on the second sheet exit tray 131, the sensors 14 and 15 may hold a state in which the second sheet exit tray 131 is arranged at the sheet eject position before the tray 131 is moved to the position shown in FIGS. 15A to 15C.

If the second sheet exit tray 131 is arranged at the position shown in FIGS. 16A to 16C and both the tray-full prediction sensor 14 and the tray-full detection sensor 15 are turned off, the display lamp 32 is switched off. If only the tray-full prediction sensor 14 is turned on and the tray-full detection sensor 15 is turned off, the display lamp 32 is switched on. If both the tray-full prediction sensor 14 and the tray-full detection sensor 15 are turned on, the display lamp 32 is switched on and off. By thus controlling the display of the display lamp 32 for the states of the tray-full prediction sensor 14 and the tray-full detection sensor 15, the user can be notified of the tray-full prediction and the tray-full state.

Figure 20A:
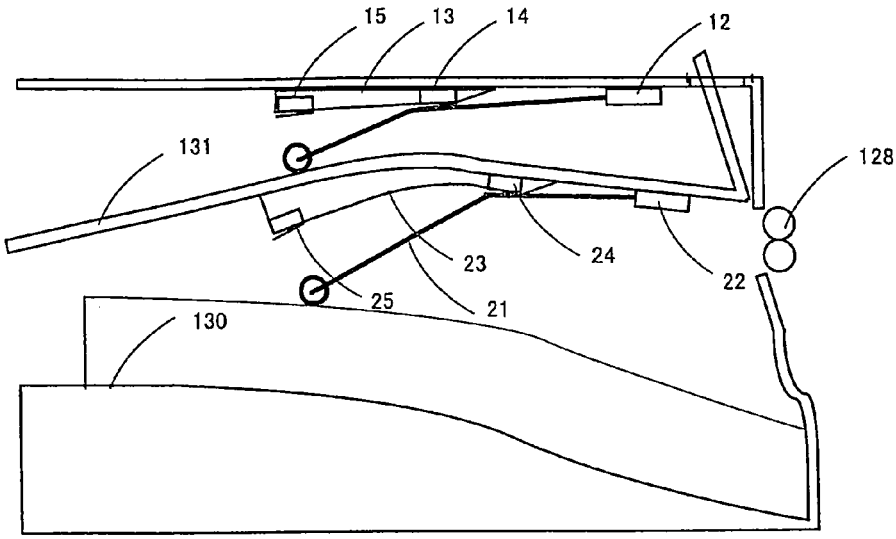
FIGS. 20A to 20C are explanatory views that illustrate an instance in which the second sheet exit tray is regularly lowered by a predetermined length during sheet eject and in which multiple tray full predictions and detections are performed by detecting states of the tray-full prediction sensor and the tray-full detection sensor according to a thirteenth embodiment of the present invention.
Figure 20B:
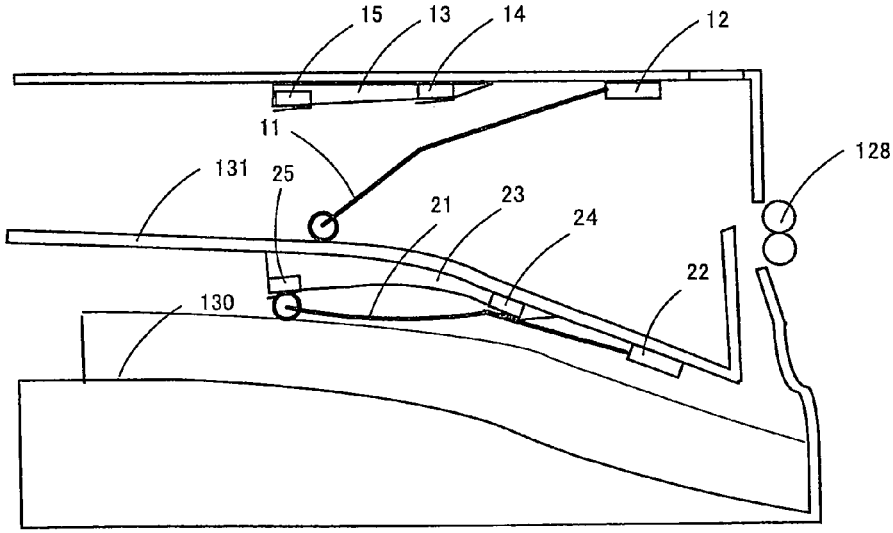
Figure 20C:
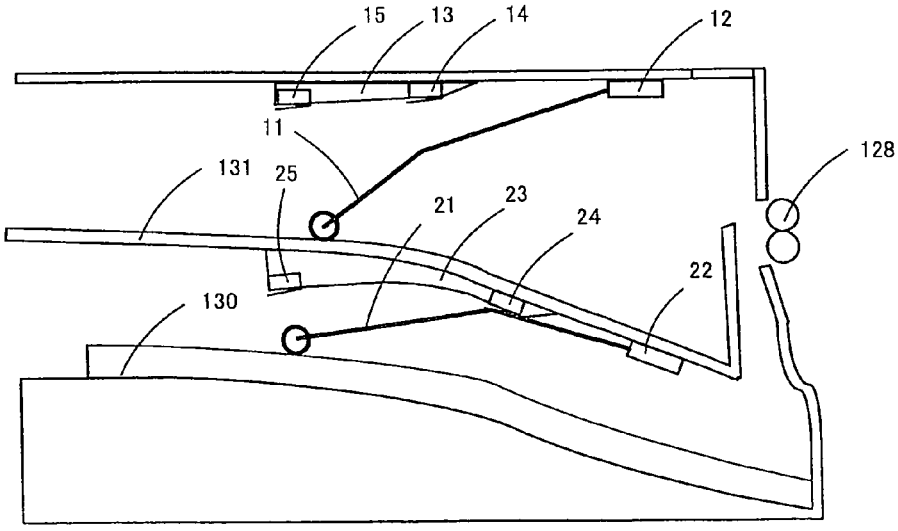

FIGS. 20A to 20C and FIG. 21B illustrate another embodiment. FIGS. 20A to 20C are explanatory views that illustrate an instance in which the second sheet exit tray 131 is made closer to the first sheet exit tray 130 by a predetermined distance during an interval of the sheet eject, states of the tray-full prediction sensor and the tray-full detection sensor are detected, and in which multiple stages of the tray-full prediction and the tray-full detection are performed. FIG. 21B illustrates an example of the display section if three stages of the tray-full prediction and the tray-full display are performed.

As shown in FIG. 15A, for example, if no sheets are stacked on the first sheet exit tray 130, all four display lamps 31 are turned off. When ejected sheets are stacked on the first sheet exit tray 130, the second sheet exit tray 131 is regularly lowered by the predetermined distance during the interval of the sheet eject. In addition, the states of the tray-full prediction sensor 24 and the tray-full detection sensor 25 are detected at a position shown in FIG. 20B or 20C. If the sheets are then stacked on the first sheet exit tray 130 and the sheet stacking state of the tray 130 is turned into a state shown in FIG. 20B, only the first lamp 31 from the bottom is switched on. If the sheets are further stacked on the first sheet exit tray 130 and the sheet stacking state of the tray 130 is turned into a state shown in FIG. 20B, first and second lamps 31 from the bottom are switched on. If the sheets are further stacked thereon, the tray-full sensor 25 is turned on before the second sheet exit tray 131 reaches the predetermined position while the second sheet exit tray 131 is lowered to the position shown in FIG. 20B. With this state set as a lower limit of the movement of the tray 131, the second sheet exit tray 131 is not lowered any further. However, since the user may possibly remove the sheets during the sheet eject, the second sheet exit tray 131 continues to be regularly lowered. If the sheets are stacked on the first sheet exit tray 130 without removing the sheets, the tray-full prediction sensor 24 is turned on while the second sheet exit tray 131 is located at the retreat position as shown in FIG. 20A. In this state, first to third display lamps 31 from the bottom are switched on. If the tray-full detection sensor 25 is turned on as shown in FIG. 15C, then the first lamp 31 from the top is switched on and off and the further eject of sheets is stopped. If the user notices that the first lamp of the display lamp 31 from the top is switched on and off, removes the sheets from the first sheet exit tray 130, and the sheet stacking state of the first sheet exit tray 130 is turned into a state shown in FIG. 15A, all the lamps of the display lamp 31 are turned off. Namely, if both the tray-full prediction sensor 24 and the tray-full detection sensor 25 are turned off while the second sheet exit tray 131 is located at the lowered position, all the display lamps 31 are turned off. If the second sheet exit tray 131 is located at the lowered position, only the tray-full prediction sensor 24 is turned on, and the tray-full detection sensor 25 is turned off, the first display lamp 31 from the bottom is switched on. If both the tray-full prediction sensor 24 and the tray-full detection sensor 25 are turned on while the second sheet exit tray 131 is located at the lowered position, the first and second display lamps 31 from the bottom are switched on and off. If the second sheet exit tray 131 is located at the sheet eject position, only the tray-full prediction sensor 24 is turned on, and the tray-full detection sensor 25 is turned off, the first to third display lamps 31 from the bottom are switched on. If the second sheet exit tray 131 is located at the sheet eject position and both the tray-full prediction sensor 24 and the tray-full detection sensor 25 are turned on, the first to third display lamps 31 from the bottom are switched on and the first display lamp 31 from the top is switched on and off. By thus controlling the display of the display lamps 31 for the states of the tray-full prediction sensor 24 and the tray-full detection sensor 25, the user can be notified of the tray-full prediction and the tray-full state.

For brevity, the instance in which the sheets are ejected to the first sheet exit tray 130 has been described. If the ejected sheets are stacked on the second sheet exit tray 131, then the second sheet exit tray 131 is regularly raised during the interval of the sheet eject to be closer to the flexure restricting member 13 provided above the tray 131, and the states of the tray-full prediction sensor 24 and the tray-full detection sensor 25 are detected. Multiple stages of the tray-full prediction can be, therefore, performed. Based on these detection results, the display of the display lamp 32 can be controlled.

Further, if the tray-full detection sensor or the tray-full prediction sensor is also used to detect the upper limit or the lower limit of the movable tray as described in the twelfth embodiment, an abnormality during movement of the movable tray may be displayed based on the detection of the tray-full detection sensor or the tray-full prediction sensor. For example, if the tray-full detection sensor or the tray-full prediction sensor also used as the lower limit sensor does not detect the lower limit despite the movement of the movable tray downward for a predetermined time, an abnormality may possibly occur to a tray moving mechanism or a sensor detection mechanism. In this case, the movement of the movable tray may be stopped and the operational abnormality may be displayed on the display section. If the tray-full detection sensor or the tray-full prediction sensor is also used to detect the upper limit of the movable tray but does not detect the upper limit despite the movement of the movable tray upward for a predetermined time, then the movement of the movable tray may be stopped and the operational abnormality may be displayed on the display section. The operational abnormality of the movable tray may be displayed on an operation section for user's operating the image forming apparatus.

Fourteenth Embodiment

Furthermore, the failure-to-fetch-sheets sensor may be provided on the sheet exit tray and the display may be performed based on the detection of this sensor. If sheets remain on the sheet exit tray to the extent that the sheets do not reach the stacking height corresponding to the tray-full prediction, it is often preferable to notify the user of this state and indicate the user to completely remove the sheets.

For example, if the tray-full detection sensor or the tray-full prediction sensor is also used to detect the upper limit or lower limit of the movable tray, it is preferable to completely remove the sheets so as to accurately determine the position of the movable sheet as already described in the twelfth embodiment.

In addition, it is often preferable to urge the user to completely remove the sheets from the sheet exit tray for the following reasons. Recently, a multifunctional machine that operates as a printer, a copier, and a facsimile machine, and that can perform a plurality of reading and printing modes has increasingly become popular. Such a multifunctional machine includes the "movable job separator" that branches an eject destination into a plurality of destinations according to a plurality of processing modes such as a printer mode, a copier mode, and a facsimile mode as already described above. If the multifunctional machine operates as the copier, the user mounts an original on the original base plate of the machine, copies the original, and fetches ejected sheets. It is, therefore, estimated that there is a low probability the sheets are left on the original base plate. If the multifunctional machine operates as the printer particularly in a shared environment in which the machine is connected to the network, the user performs a printing operation in a host located apart from the printer and goes to the printer to fetch ejected sheets at an appropriate time at which the printing is completed. In such an environment, it is convenient if the user can know when the sheets are ejected. Namely, if the multifunctional machine operates as the printer, information that the user wants to know is not information as to whether a certain amount of sheets are stacked on the sheet exit tray but information as to when the sheets printed by the user are ejected to the sheet exit tray. Due to this, it is preferable to provide a sensor on the sheet exit tray to notify the user that a first sheet has been ejected.

If the multifunctional machine operates as the facsimile machine, the machine receives data transmitted from many and unspecified senders at unspecified timings. Since the machine cannot predict when the data is transmitted, it is preferable to remove sheets from the sheet exit tray at an earlier timing so as to be able to have enough time to avoid the tray-full state. Accordingly, if even one sheet is received and stacked on the sheet exit tray, it is preferable to notify the user of the reception of the sheet and urge the user to remove the sheet from the sheet exit tray. In addition, it is preferable to notify the user of the reception of even one sheet so that the received data can be transmitted to a destination person as early as possible.

Referring to FIGS. 15A to 15C, the failure-to-fetch-sheets sensor 26 is arranged on the first sheet exit tray 130 and the failure-to-fetch-sheets sensor 16 is arranged on the second sheet exit tray 131. However, it is preferable to provide the failure-to-fetch-sheets sensor on the sheet exit tray for the printer and the facsimile machine other than the copier as described above. Accordingly, if the first sheet exit tray 130 is used as a sheet exit tray for the copier and the second sheet exit tray 131 is used as a sheet exit tray for the printer and the facsimile machine, for example, the failure-to-fetch-sheets sensor may be provided only on the second sheet exit tray. FIGS. 16A to 16C illustrate an example of such a configuration. The failure-to-fetch-sheets sensor 16 is arranged on the second sheet exit tray 131 but the failure-to-fetch-sheets sensor 26 is not arranged on the first sheet exit tray 130.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet stacking device comprising:

an evacuation section for transporting and ejecting sheets;

a sheet exit tray for stacking the ejected sheets;

an arm supporting member; and a sheet presser arm including a supported end immovably, substantially integrally and fixedly supported by and immovably, substantially integrally and fixedly attached to said arm supporting member at one end, a free end at the other end which is capable of pressing the sheets stacked on the sheet exit tray directly or via a contact member attached to the free end, and a flexure portion having flexibility extending between the immovably, substantially integrally and fixedly supported and immovably, substantially integrally and fixedly attached end and the free end, wherein the arm applies via the flexibility of the flexure portion, a pressing force to sheets stacked on the sheet exit tray and a repulsive force to each ejected sheet when a front end of the ejected sheet strikes against the arm, and wherein the arm has a bend between the immovably, substantially integrally and fixedly supported and immovably, substantially integrally and fixedly attached end and the free end, and the shape of the arm is determined in view of an attachment angle of the immovably, substantially integrally and fixedly supported and immovably, substantially integrally and fixedly attached end of the arm with respect to a horizontal direction, the length of the flexure portion between the immovably, substantially integrally and fixedly supported and immovably, substantially integrally and fixedly attached end and the bend, and the length of the flexure portion between the bend and the free end.

2. The sheet stacking device according to claim 1, wherein the sheet exit tray includes:

a sheet stacking section for obliquely stacking ejected sheets so that an upstream side of each ejected sheet in an ejection direction is at a lower position than a downstream side of the ejected sheet; and a sheet restricting section is located at an upstream side end of the sheet stacking section, the arm is disposed in such a manner that the shortest distance between the evacuation section and a position at which the arm strikes against the front ends of the ejected sheets and an angle between the arm and the ejected sheets at the position at which the arm strikes against the front ends of the ejected sheets are determined so that (1) the free end of the arm is situated at a position at which the shortest distance between the evacuation section and a point at which the free end of the arm, or the contact member attached thereto, comes into contact with the sheet exit tray is greater than the length of an ejected sheet of a first size in a transport direction, (2) after a rear end of an ejected sheet of the first size passes through the evacuation section, a front end of that ejected sheet strikes against the arm in a state in which a transport force is not applied from the evacuation section to the ejected sheet and the ejected sheet falls downward while the moving speed of the ejected sheet in an ejection direction is reduced or while the ejected sheet is moved to a direction opposite to the ejection direction by a repulsive force from the arm, and (3) a front end of an ejected sheet of a second size larger than the first size strikes against the arm and passes below the free end of the arm in a state in which a transport force is applied from the evacuation section to the ejected sheet, and movement of the ejected sheet in the ejection direction stops after a rear end of the ejected sheet passes through the evacuation section, and the sheet exit tray is disposed in such a manner that the position of the tray relative to the arm and the inclination of the tray relative to a horizontal plane are determined so that ejected sheets of the first size falling downward on the sheet exit tray are stacked while being inclined toward the upstream side, and so that ejected sheets of the second size whose front end passes below the free end of the arm are stacked while being pressed by the free end of the arm.

3. The sheet stacking device according to claim 2, wherein the arm is configured such that when a front end of an ejected sheet strikes against the arm, the ejected sheet receives a repulsive force from the arm due to the self-weight or flexibility of the arm or due to both, and the angle between the arm and a traveling direction of the front end of the ejected sheet striking against the arm, the self-weight of the arm, the flexibility of the arm or all of these are determined so that after the front end of an ejected sheet of the first size strikes against the arm in the state in which a transport force is not applied from the evacuation section to the ejected sheet, the ejected sheet falls downward while the moving speed of the ejected sheet in the ejection direction is reduced or while the ejected sheet is moved to the direction opposite to the ejection direction, and so that after the front end of an ejected sheet of the second size strikes against the arm in the state in which a transport force is applied from the evacuation section to the ejected sheet of the second size, the front end of the ejected sheet descends and passes below the free end of the arm.

4. The sheet stacking device according to claim 1, wherein the flexibility and the shape of the arm are determined so that a pressing force that does not obstruct traveling of each ejected sheet passing below the free end of the arm is applied to each of the ejected sheets in a sheet stacking state equal to or smaller than an allowable stacking amount.

5. The sheet stacking device according to claim 1, wherein the flexibility and the shape of the arm are determined so that when the front end of each ejected sheet strikes against the arm in a state in which a transport force is not applied from the sheet evacuation section to the sheet, the ejected sheet falls downward while the moving speed of the ejected sheet in an ejection direction is reduced or while the ejected sheet is moved to a direction opposite to the ejection direction by a repulsive force from the arm.

6. The sheet presser arm according to claim 5, wherein the arm has a bend between the immovably, substantially integrally and fixedly supported and immovably, substantially integrally and fixedly affixed end and the free end, and the shape of the arm is determined in view of an angle formed between two sides of the arm between which the bend is held.

7. The sheet presser arm according to claim 5, wherein the arm has a bend between the immovably, substantially integrally and fixedly supported and immovably, substantially integrally and fixedly attached end and the free end, and the shape of the arm is determined in view of the length of the flexure portion between the bend and a point at which an ejected sheet strikes against the arm.

8. An image forming apparatus comprising the sheet stacking device according to claim 1.

* * * * *